US009190233B2

(12) United States Patent
Daitoku et al.

(10) Patent No.: US 9,190,233 B2
(45) Date of Patent: Nov. 17, 2015

(54) SOLENOID DEVICE AND ELECTROMAGNETIC RELAY

(71) Applicants: ANDEN CO., LTD., Anjo, Aichi-pref. (JP); NIPPON SOKEN, INC., Nishio, Aichi (JP)

(72) Inventors: Osamu Daitoku, Kariya (JP); Tomoaki Tanaka, Okazaki (JP); Masanao Sugisawa, Hekinan (JP); Ken Tanaka, Nukata-gun (JP); Kiyonari Kojima, Miyoshi (JP)

(73) Assignees: ANDEN CO., LTD., Anjo (JP); NIPPON SOKEN, INC., Nishio (JP)

( * ) Notice: Subject to any disclaimer, the term of this patent is extended or adjusted under 35 U.S.C. 154(b) by 161 days.

(21) Appl. No.: 13/751,201

(22) Filed: Jan. 28, 2013

(65) Prior Publication Data

US 2013/0207750 A1 Aug. 15, 2013

(30) Foreign Application Priority Data

Feb. 9, 2012 (JP) ..... 2012-025937
Apr. 11, 2012 (JP) ..... 2012-090424

(51) Int. Cl.

| | |
|---|---|
| ***H01H 50/00*** | (2006.01) |
| ***H01H 9/40*** | (2006.01) |
| ***H01H 50/18*** | (2006.01) |
| ***H01H 50/54*** | (2006.01) |
| ***H01H 50/64*** | (2006.01) |
| *H01H 9/44* | (2006.01) |

(52) U.S. Cl.

CPC ..... *H01H 50/00* (2013.01); *H01H 9/40* (2013.01); *H01H 50/18* (2013.01); *H01H 50/546* (2013.01); *H01H 50/641* (2013.01); *H01H 9/443* (2013.01)

(58) Field of Classification Search

CPC ..... H01F 7/1607; H01H 47/00; H01H 50/36
USPC ..... 335/259, 265, 119, 184, 232, 242, 267
See application file for complete search history.

(56) References Cited

U.S. PATENT DOCUMENTS

| | | | | | |
|---|---|---|---|---|---|
| 269,453 | A | * | 12/1882 | Parker | 314/109 |
| 634,912 | A | * | 10/1899 | Richardson et al. | 315/211 |
| 731,741 | A | * | 6/1903 | Baxter | 335/265 |
| 946,215 | A | * | 1/1910 | Geissinger | 361/154 |
| 2,138,275 | A | * | 11/1938 | Konrad | 361/191 |
| 2,528,777 | A | * | 11/1950 | Persons | 361/194 |
| 2010/0207713 | A1 | * | 8/2010 | Sugisawa | 335/192 |

FOREIGN PATENT DOCUMENTS

| | | | |
|---|---|---|---|
| JP | 2005-222871 | A | 8/2005 |
| JP | 2010-212035 | A | 9/2010 |
| JP | 2010-287455 | A | 12/2010 |

OTHER PUBLICATIONS

U.S. Appl. No. 13/775,741, filed Feb. 25, 2013, Daitoku et al.

* cited by examiner

*Primary Examiner* — Mohamad Musleh
(74) *Attorney, Agent, or Firm* — Posz Law Group, PLC

(57) ABSTRACT

A solenoid device includes: at least one electromagnetic coil that generates a magnetic flux when the electromagnetic coil is energized; a yoke made of soft magnetic material, in which the magnetic flux flows; and a plurality of plungers, each of which includes at least a part made of soft magnetic material, and reciprocates when the electromagnetic coil is switched between energization and interruption of energization. The number of the plurality of plungers is larger than the number of the electromagnetic coil. The plurality of plungers reciprocate independently from each other.

8 Claims, 30 Drawing Sheets

SOLENOID DEVICE AND ELECTROMAGNETIC RELAY

CROSS REFERENCE TO RELATED APPLICATIONS

This application is based on Japanese Patent Applications No. 2012-025937 filed on Feb. 9, 2012, and No. 2012-090424 filed on Apr. 11, 2012, the disclosures of which are incorporated herein by reference.

TECHNICAL FIELD

The present disclosure relates to a solenoid device having an electromagnetic coil and multiple plungers and an electromagnetic relay using the solenoid device.

BACKGROUND

A solenoid device in which a plunger is made to reciprocate by using an electromagnetic coil is conventionally known as a part used for a relay or the like (refer to the following patent literatures 1 to 3). FIGS. 28 and 29 illustrate an example of a conventional solenoid device.

A conventional solenoid device 9 has two electromagnetic coils 91 each obtained by winding a conductive wire in a cylindrical shape, a yoke 92 made of soft magnetic material, and two plungers 93. Each of the plungers 93 has a core part 93*a* made of soft magnetic material and a contact part 93*b* made of insulating member. The core part 93*a* is disposed in the center of the electromagnetic coil 91. The yoke 92 is constructed by combining a plurality of magnetic members. In the center of the electrometric coil 91, an in-coil yoke 92*a* as a part of the yoke 92 is provided.

As illustrated in FIG. 29, when current is passed to the electromagnetic coil 91, a magnetic flux Φ is generated. The magnetic flux Φ flows in the core part 93*a* of the plunger 93 and the yoke 92. Consequently, the core part 93*a* is magnetized and attracted by the in-coil yoke 92*a*. A spring member 97 is provided between the core part 93*a* and the in-coil yoke 92*a*. As illustrated in FIG. 28, when the current to the electromagnetic coil 91 is stopped, the magnetic flux Φ vanishes. By the pressing force of the spring member 97, the core part 93*a* moves apart from the in-coil yoke 92*a*.

The solenoid device 9 is used for a relay 90. The relay 90 has two contact parts 96. Each of the contact parts 96 has a moving-contact supporting part 94 supporting a moving contact 940 and a fixed-contact supporting part 95 supporting a fixed contact 950. As illustrated in FIGS. 28 and 29, by making the plunger 93 reciprocate in the axial directions (Z directions) of the electromagnetic coil 91, the contact part 93*b* of the plunger 93 is made contact with the moving-contact supporting part 94, and the moving contact 940 and the fixed contact 950 come into contact with each other and are moved apart from each other. In such a manner, the relay 90 is turned on/off.

In the conventional solenoid device 9, however, one plunger 93 is made to reciprocate by using one electromagnetic coil 91. Consequently, in the case of making the plurality of contacts 96 come into contact and moved apart, the electromagnetic coils 91 of the number corresponding to the number of contacts 96 are required. There is a problem that the number of the electromagnetic coils 91 easily increases. Since the electromagnetic coil 91 is relatively expensive, when the number of electromagnetic coils 91 increases, the size increases, and the manufacture cost of the solenoid device 9 easily rises.

To solve the problem, a solenoid device 9 is proposed in which a plurality of plungers 93 are coupled and integrated, and the integrated plungers 93 are made to reciprocate by using one electromagnetic coil 91 as illustrated in FIG, 30. However, for example, when one of the plurality of contacts 96 adheres, all of the plungers 93 do not reciprocate. As a result, a problem occurs such that the relay 90 cannot be turned off.

The patent literature 2 discloses a solenoid device in which plungers are disposed on the inside of one electromagnetic coil. The solenoid device, however, has a problem such that, since a plurality of plungers are disposed on the inside of the electromagnetic coil, the size of the electromagnetic coil is large. The patent literature 3 discloses a solenoid device in which two plungers are attracted by using two electromagnetic coils. With the configuration, however, the number of electromagnetic coils is large. There is a problem such that the size of the solenoid device cannot be reduced.

Patent Literature 1: Japanese Unexamined Patent Application Publication No. 2005-222871

Patent Literature 2: Japanese Unexamined Patent Application Publication No. 2010-212035

Patent Literature 3: Japanese Unexamined Patent Application Publication No. 2010-287455

SUMMARY

It is an object of the present disclosure to provide a small-sized low-manufacture-cost solenoid device having an electromagnetic coil and multiple plungers, in which, even in the case one of a plurality of plungers does not operate, the other plungers can reciprocate. It is another object of the present disclosure to provide an electromagnetic relay using the solenoid device.

According to a first aspect of the present disclosure, a solenoid device includes: at least one electromagnetic coil that generates a magnetic flux when the electromagnetic coil is energized; a yoke made of soft magnetic material, in which the magnetic flux flows; and a plurality of plungers, each of which includes at least a part made of soft magnetic material, and reciprocates when the electromagnetic coil is switched between energization and interruption of energization. The number of the plurality of plungers is larger than the number of the electromagnetic coil. The plurality of plungers reciprocate independently from each other.

In the above solenoid device, the manufacture cost of the solenoid device can be reduced. In addition, the solenoid device can be miniaturized. Further, even in the case where something abnormal occurs and one of the plurality of plungers does not reciprocate, the other plungers can be operated normally. Thus, the small-sized low-manufacture-cost solenoid device, in which even in the case one of the plurality of plungers does not operate, the other plungers can reciprocate, is provided.

According to a second aspect of the present disclosure, an electromagnetic relay includes: the solenoid device according to the first aspect; a plurality of contact parts, each of which is switchable between an on state for flowing current and an off state for interrupting the current; and an arc contact preventing plate made of an insulating material and disposed between the plurality of contact parts. The arc contact preventing plate prevents from contacting arcs, which are generated in the contact parts, respectively, when the contact parts are switched from the on state to the off state. The arc contact preventing plate includes a through hole.

In the above case, the arc can be extinguished quickly. When the through hole is formed in the arc contact preventing plate, the metallic vapor can be moved via the through hole from the space in which the concentration of the metallic vapor is high to the space in which the concentration is low. Consequently, local increase in the concentration of the metallic vapor can be suppressed, and the arcs can be extinguished quickly.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION (First Embodiment)

An embodiment of a solenoid device will be described with reference to FIGS. 1 to 7.

Figure 1:
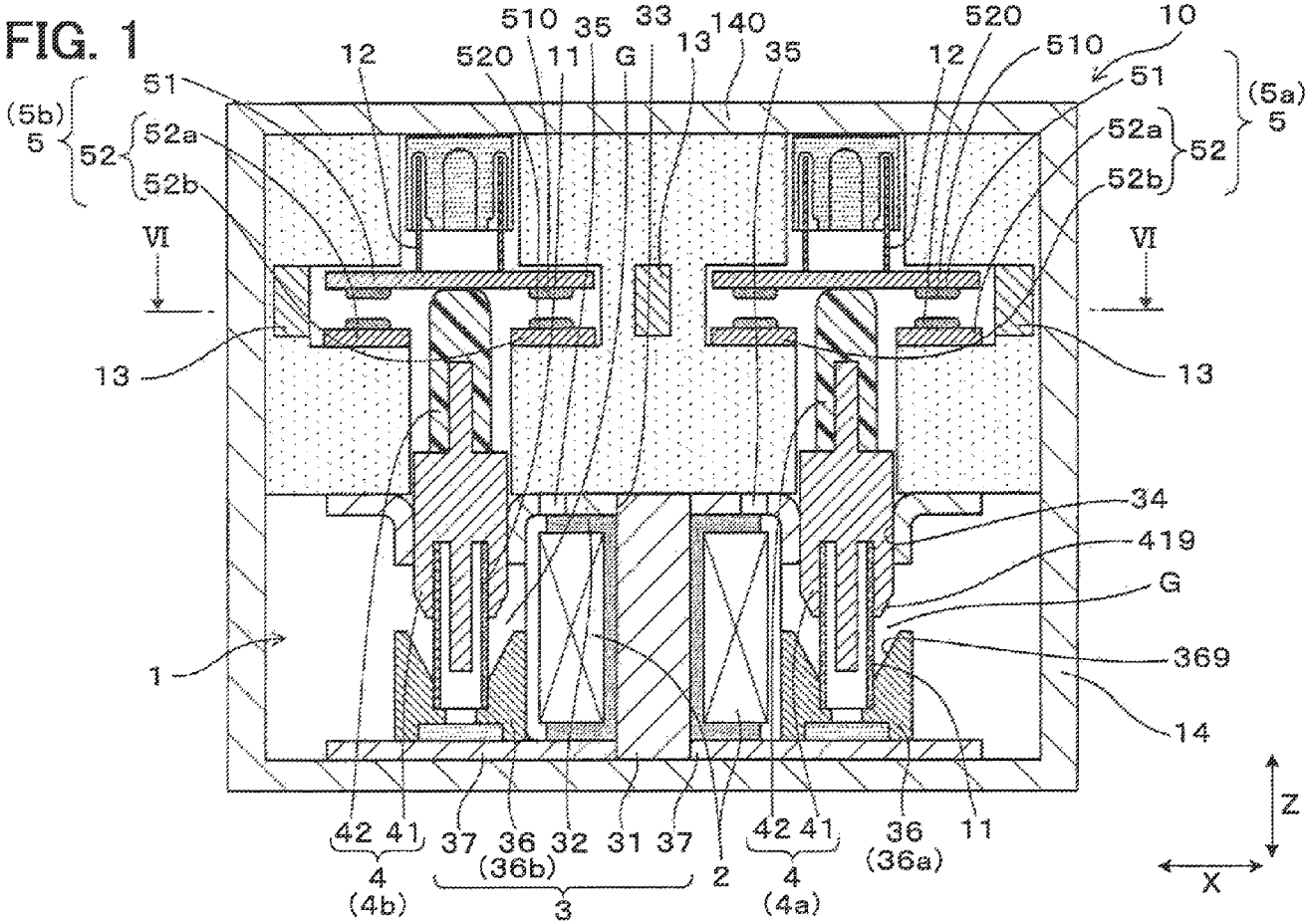
FIG. 1 is a cross section taken along line I-I of FIG. 3 and illustrates an off state of a solenoid device in a first embodiment.
Figure 2:
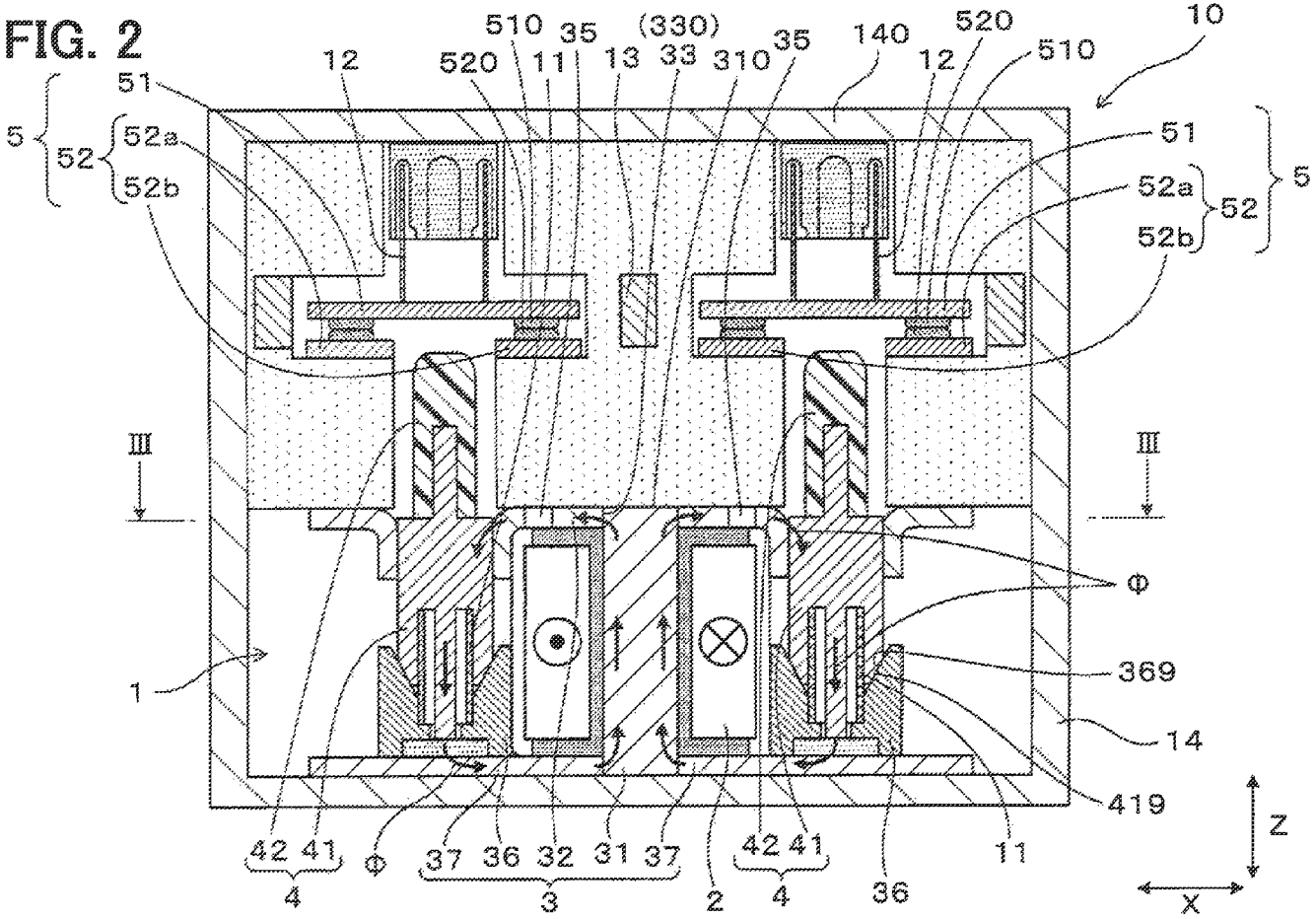
FIG. 2 is a cross section illustrating an on state of the solenoid device of FIG. 1.

As illustrated in FIGS. 1 and 2, a solenoid device 1 of a first embodiment has an electromagnetic coil 2, a yoke 3 made of soft magnetic material, and a plurality of plungers 4. The plunger 4 is formed in a rod shape and a part (core part 41A) of the plunger 4 is made of soft magnetic material. When current is passed to the electromagnetic coil 2, a magnetic flux $\Phi$ is generated and flows in the yoke 3 and the plunger 4.

By switching passage of current to the electromagnetic coil 2, the plurality of plungers 4 reciprocate in the axial directions (Z directions) of the electromagnetic coil 2. The number (two) of the plungers 4 is larger than the number (one) of the electromagnetic coil 2. The plurality of plungers 4 can reciprocate independently of one another. Two plungers 4 are disposed on the outside of the electromagnetic coil 2.

The solenoid device 1 of the embodiment is used for an electromagnetic relay 10. In a case 14 of the electromagnetic relay 10, the solenoid device 1 and two contact parts 5 are housed. Each of the contact parts 5 has a moving-contact supporting part 51 supporting a moving contact 510 and two fixed-contact supporting parts 52 (52*a* and 52*b*) supporting a fixed contact 520. As illustrated in FIGS. 1 and 2, by making the plungers 4 reciprocate, the moving contact 510 and the fixed contact 520 come into contact with each other or become apart from each other. By the operation, an on state (refer to FIG. 2) in which current is passed between the two fixed-contact supporting parts 52*a* and 52*b* via the movable-contact supporting part 51 and an off state (refer to FIG. 1) in which no current flows are switched.

As described above, in the embodiment, the two plungers 4 can reciprocate independently of each other. With the configuration, the on state and the off state of the two contact parts 5 can be switched independently of each other.

The plunger 4 has a core part 41 made of soft magnetic material and a contact part 42 made of insulating material. The electromagnetic coil 2 is formed by winding a conductive line in a cylindrical shape. The axial line of the plunger 4 is parallel to the center axis of the electromagnetic coil 2. The two plungers 4 are disposed on the outside of the electromagnetic coil 2.

The yoke 3 is made by a pillar-shaped yoke 31, a plate-shaped yoke 32, two attraction yokes 36, and a bottom yoke 37. The pillar-shaped yoke 31 has a cylindrical shape and is disposed so as to penetrate the center of the turns of the electromagnetic coil 2. The main face of the plate-shaped yoke 32 and that of the bottom yoke 37 are orthogonal to the axial direction (Z direction) of the electromagnetic coil 2. The plate-shaped yoke 32 is connected to the end on the contact part 5 side in the Z direction of the pillar-shaped yoke 31, and the bottom yoke 37 is connected to the end on the opposite side. The two attraction yokes 36 are disposed on the outside in the radial direction of the electromagnetic coil 2 and are in contact with the bottom yoke 37.

A plunger pressing member 11 (spring member) for pressing the plunger 4 toward the moving-contact supporting part 51 side in the Z direction is provided between the core part 41 of the plunger 4 and the attraction yoke 36.

As illustrated in FIG. 2, when current is passed to the electromagnetic coil 2, the magnetic flux Φ is generated around the electromagnetic coil 2. The magnetic flux Φ flows in the pillar-shaped yoke 31, the plate-shaped yoke 32, the core part 41, the attraction yoke 36, and the bottom yoke 37. Consequently, the core part 41 is magnetized, and the core part 41 is attracted by the attraction yoke 36 against the pressing force of the plunger pressing member 11.

In the core part 41 and the attraction yoke 36, contact faces 419 and 369 which come into contact with each other are formed. The contact face 419 of the core part 41 is a projected conical surface, and the contact face 369 of the attraction yoke 36 is a recessed conical surface.

As illustrated in FIG. 1, when passage of current to the electromagnetic coil 2 is stopped, the magnetic flux Φ vanishes. Consequently, the core part 41 is not attracted by the attraction yoke 36 and, by the pressing force of the plunger pressing member 11, the plunger 4 is pressed to the moving-contact supporting unit 51 side in the Z direction.

Between an upper wall 140 of the casing 14 and the moving-contact supporting unit 51, a contact pressing member 12 for pressing the moving-contact supporting part 51 to the side of the fixed-contact supporting member 52 in the Z direction is provided. The spring constant of the contact pressing member 12 is smaller than that of the plunger pressing member 11.

As illustrated in FIG. 2, when current is passed to the electromagnetic coil 2 and the plunger 4 is attracted by the attraction yoke 36, the moving-contact supporting part 51 is pressed in the Z direction by the pressing force of the contact pressing member 12 and the moving contact 510 comes into contact with the fixed contact 520. It results in the on state where current flows between the two fixed-contact supporting parts 52*a* and 52*b* via the moving-contact supporting part 51.

When passage of current to the electromagnetic coil 2 is stopped as illustrated in FIG. 1, the plunger 4 is pressed toward the moving-contact supporting part 51 side in the Z direction by the pressing force of the plunger pressing member 11. The contact part 42 of the plunger 4 comes into contact with the moving-contact supporting part 51 and the moving-contact supporting part 51 is moved toward the upper wall 140 side against the pressing force of the contact pressing member 12. It results in the off state where the moving contact 510 comes apart from the fixed contact 520, and no current flows between the two fixed-contact supporting parts 52*a* and 52*b*.

The electromagnetic relay 10 has a plurality of arc-extinction magnets 13. In the case of switching the on state to the off state, an arc is generated between the moving contact 510 and the fixed contact 520. A magnetic field is applied to the arc by using the arc-extinction magnets 13, and the ark is extended by the Lorentz force and extinguished. By the operation, the current flowing between the fixed-contact supporting parts 52*a* and 52*b* can be interrupted promptly.

In the embodiment, as illustrated in FIG. 2, two plungers 4 are magnetically connected in parallel by the yoke 3. That is, the magnetic flux generated by the electromagnetic coil 2 is branched in the yoke 3 and passed separately to the two plungers 4.

On the other hand, the plate-shaped yoke 32 is formed in a rectangle shape. The plate-shaped yoke 32 has two plunger insertion holes 34 through which the plungers 4 pass and a yoke engagement hole 330 formed between the two plunger insertion holes 34. The yoke engagement hole 330 is formed in a circular shape, and the pillar-shaped yoke 32 comes into engagement in the yoke engagement hole 330. The inner peripheral face of the yoke engagement hole 330 is a connection part 33 in which the plate-shaped yoke 32 and the pillar-shaped yoke 31 are connected.

The plate-shaped yoke 32 has two through holes 35. The through hole 35 is formed so as to penetrate in the Z direction between the connection part 33 and the plunger insertion hole 34. Parts positioned on both sides of the through hole 35 in the width direction (Y direction) orthogonal to both the alignment direction (X direction) of the yoke engagement hole 330 and the plunger insertion hole 34 and the Z direction are magnetic saturation parts 30 which magnetically saturate when current is passed to the electromagnetic coil 2. By the magnetic saturation parts 30, the amount of the magnetic flux Φ flowing in the core part 41 is regulated.

In the plate-shaped yoke 32, four magnetic saturation parts 30 are formed as first to fourth magnetic saturation parts 30*a* to 30*d*. The lengths of the four magnetic saturation parts 30 in the Y direction are equal to one another. That is, amounts of the magnetic flux Φ flowing in the four magnetic saturation parts 30 are equal to one another.

The magnetic flux Φ generated by passage of current to the electromagnetic coil 2 passes from the pillar-shaped yoke 31 to the plate-shaped yoke 32 via the connection part 33, is branched, and passes through the four magnetic saturation parts 30*a* to 30*d*. To a core part 41*a* as one of the two core parts 41, a magnetic flux Φ1 which passed through the first magnetic saturation part 30*a* and a magnetic flux Φ2 which passed through the second magnetic saturation part 30*b* flow. To the other core part 41*b*, a magnetic flux Φ3 which passed through the third magnetic saturation part 30*c* and a magnetic flux Φ4 which passed through the fourth magnetic saturation part 30*d* flow. In such a manner, the magnetic fluxes Φ1 and Φ2 take a detour via the through holes 35*a* and enter the core 41*a*. The magnetic fluxes Φ3 and Φ4 also take a detour via the through hole 35*b* and enter the other core 41*b*.

Figure 4:
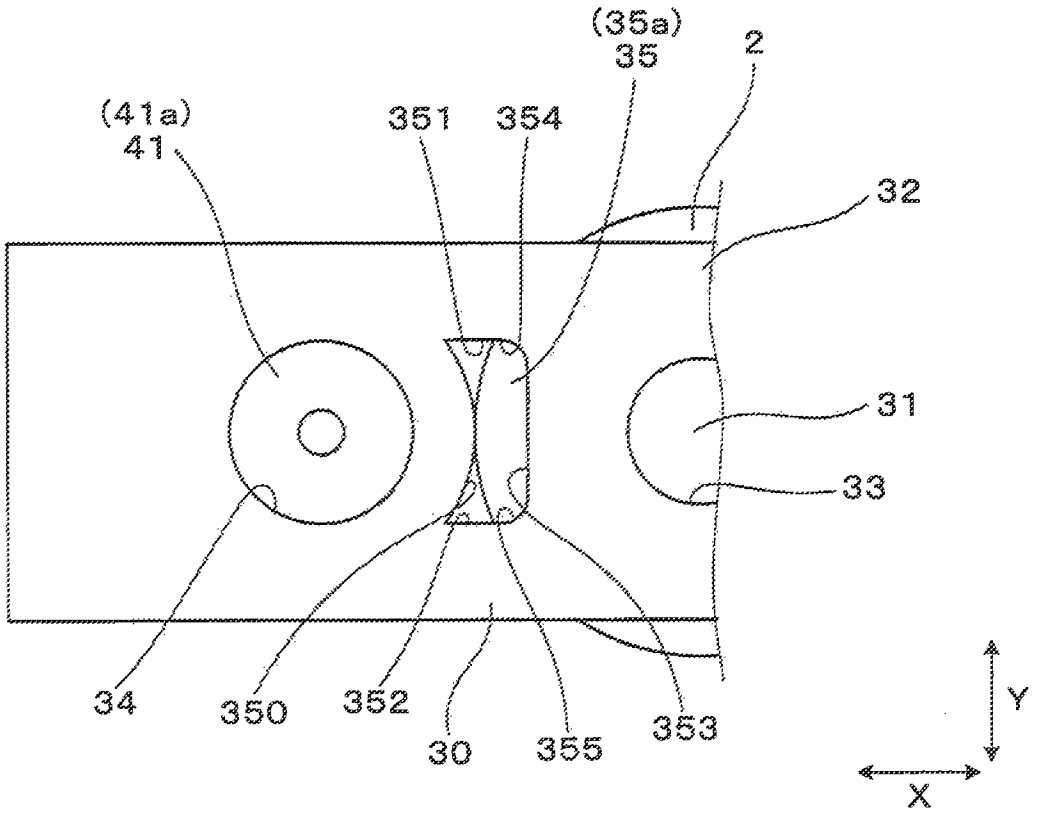
FIG. 4 is an enlarged view of a main part of FIG. 3.

As illustrated in FIG. 4, the through hole 35 has a circular-arc face 350 formed in a circular arc shape which is concentric with the plunger insertion hole 34, two side faces 351 and 352 continued to the circular-arc face 350 and parallel to the X direction, and an inner face 353 continued to the side faces 351 and 352 and parallel to the Y direction. Each of a connection face 354 connecting the inner face 353 and the side face 351 and a connection face 355 connecting the inner face 353 and the side face 352 is curved in a circular arc shape. The length of the through hole 35 in the Y direction is almost equal to the diameter of the plunger insertion hole 34.

Figure 5:
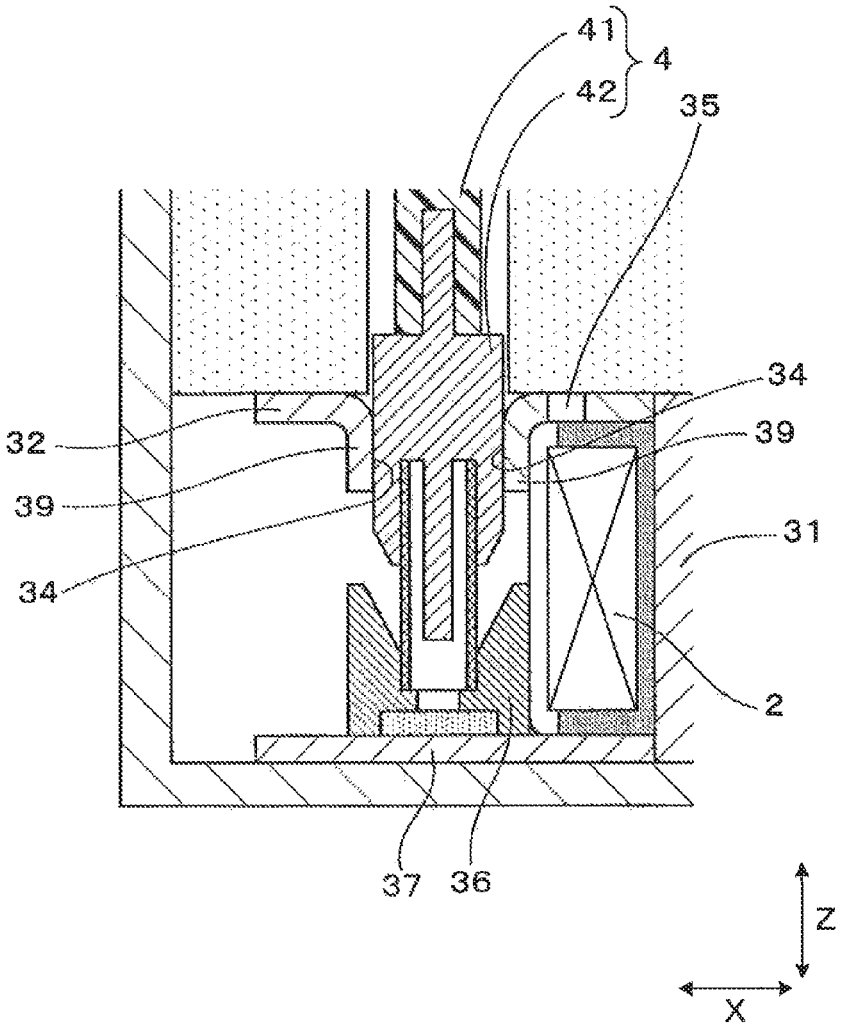
FIG. 5 is an enlarged view of a main part of FIG. 1.

As illustrated in FIG. 5, in the plate yoke 32, a cylindrical part 39 projected toward the attraction yoke 36 in the Z direction is formed. The inner side of the cylindrical part 39 is the plunger insertion hole 34. The diameter of the plunger insertion hole 34 and that of the core part 41 are almost equal to each other. The core part 41 reciprocates in the Z directions while being in slide contact with the inner face of the plunger insertion hole 34.

Figure 6:
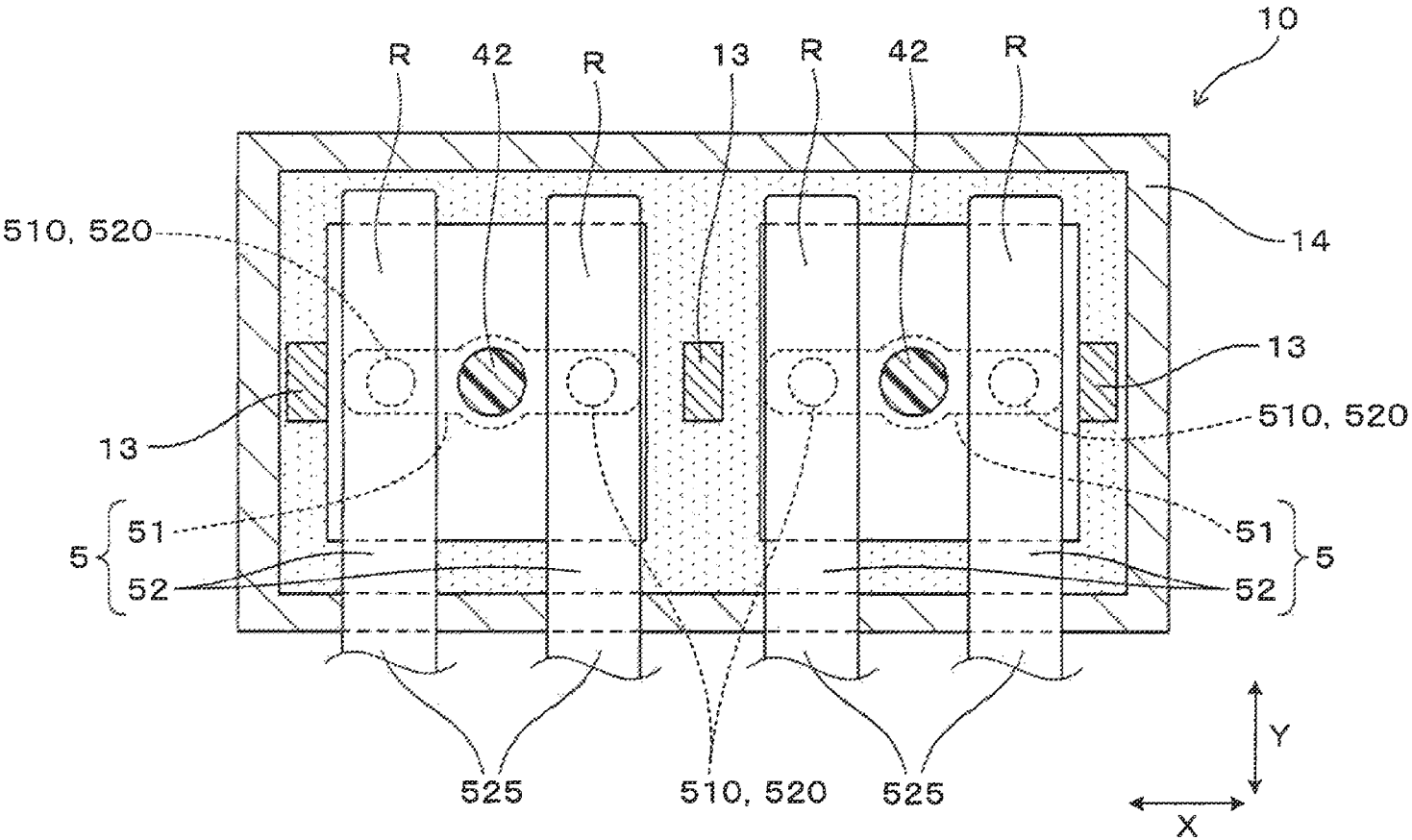
FIG. 6 is a cross section taken along line VI-VI of FIG. 1.

On the other hand, as illustrated in FIG. 6, the fixed contact supporting part 52 extends in the Y direction, and a part of it projects to the outside of the casing 14. The part projected from the casing 14 serves as a connection terminal 525 of the electromagnetic relay 10.

The arc-extinction magnets 13 are provided in the positions adjacent to the moving contact 510 and the fixed contact 520 in the X direction. In the casing 14, arc extinction rooms R are formed in positions adjacent to the moving contact 510 and the fixed contact 520 in the Y direction. In the case of switching the contact part 5 from the on state to the off state, the arc generated between the moving contact 510 and the fixed contact 520 is extended by the magnetic field of the arc-extinction magnet 13 in the Y direction into the arc extinction room R and extinguished.

Figure 7:
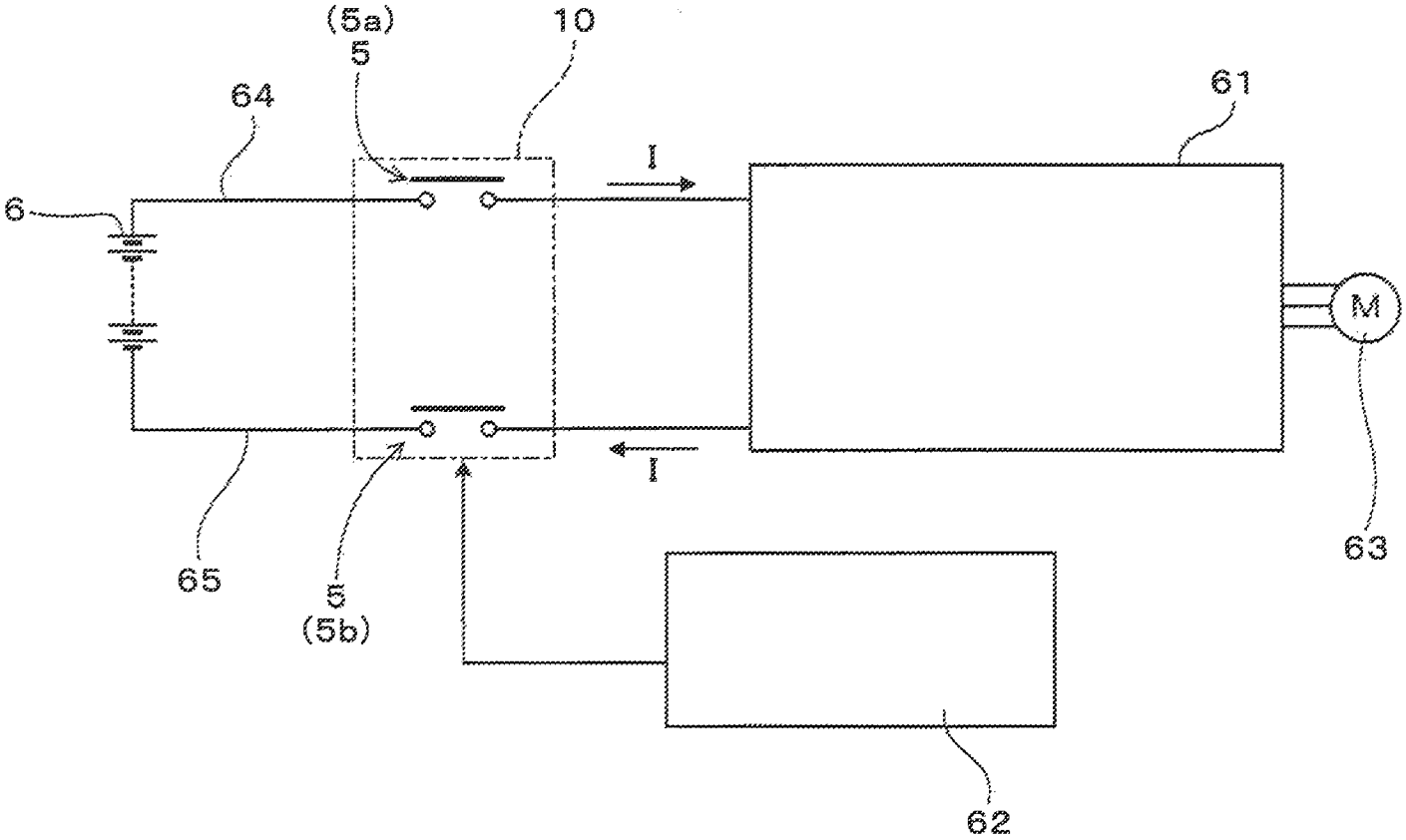
FIG. 7 is a circuit diagram using an electromagnetic relay of the first embodiment.

Next, a circuit using the electromagnetic relay 10 of the embodiment will be described. As illustrated in FIG. 7, the electromagnetic relay 10 of the embodiment is used for connecting an inverter 61 and a DC power supply 6. The electromagnetic relay 10 is combined with the DC power supply 6 and provided as an assembled battery. The inverter 61 converts DC power of the DC power supply 6 to AC power and drives a three-phase AC motor 63 by using the AC power. The electromagnetic relay 10 has the two contact parts 5 (5*a* and 5*b*). The contact part 5*a* as one of the two contact parts 5 is provided for a positive power line 64 connecting the positive electrode of the DC power supply 6 and the inverter 61, and the other contact part 5*b* is provided for a negative power line 65 connecting the negative electrode of the DC power supply 6 and the inverter 61. By switching the on state and the off state of the electromagnetic relay 10 by using a control circuit 62, the inverter 61 is connected/disconnected to/from the DC power supply 6.

At the time of switching the electromagnetic relay 10 from the on state to the off state, there is a case that one of the two contact parts 5 (5*a* and 5*b*) adheres. Even in this case, if the other contact 5 can be turned off, DC current I flowing in the inverter 61 can be interrupted.

The effect of the embodiment will be described. As illustrated in FIGS. 1 and 2, in the solenoid device 1 of the embodiment, the number (two) of the plungers 4 is larger than the number (one) of the electromagnetic coil 2. Consequently, the larger number of plungers 4 can be made to reciprocate by the smaller number of the electromagnetic coil 2, and the manufacture cost of the solenoid device 1 can be reduced. In addition, the solenoid device 1 can be miniaturized.

The solenoid device 1 of the embodiment is constructed so that the plurality of plungers can reciprocate independently of one another. Switching between the on state and the off state can be performed in each of the plurality of contact parts 5. Consequently, even in the case where one of the plurality of plungers 4 does not reciprocate due to adhesion of the contact part 5 or the like, the other plungers 4 can be operated normally.

In the embodiment, as illustrated in FIG. 2, two plungers 4 are magnetically connected in parallel by the yoke 3.

With such a configuration, the force of attracting each of the plungers 4 of the attraction yoke 36 can be increased. Specifically, as illustrated in FIG. 1, a gap G is created between the plunger 4 and the attraction yoke 36 in the off state. At the time of passing the magnetic flux Φ, the gap G becomes magnetic resistance. Consequently, if the plungers 4 are magnetically connected in series, the entire magnetic resistance becomes higher, the magnetic flux Φ flowing in the plungers 4 decreases, and the force of attracting the plungers 4 becomes weaker. However, by magnetically connecting the plungers 4 in parallel like in the embodiment, the entire magnetic resistance can be reduced, and the magnetic flux Φ flowing in the plungers 4 can be increased. Therefore, the force of attracting the plungers 4 of the attraction yoke 36 can be increased.

Figure 3:
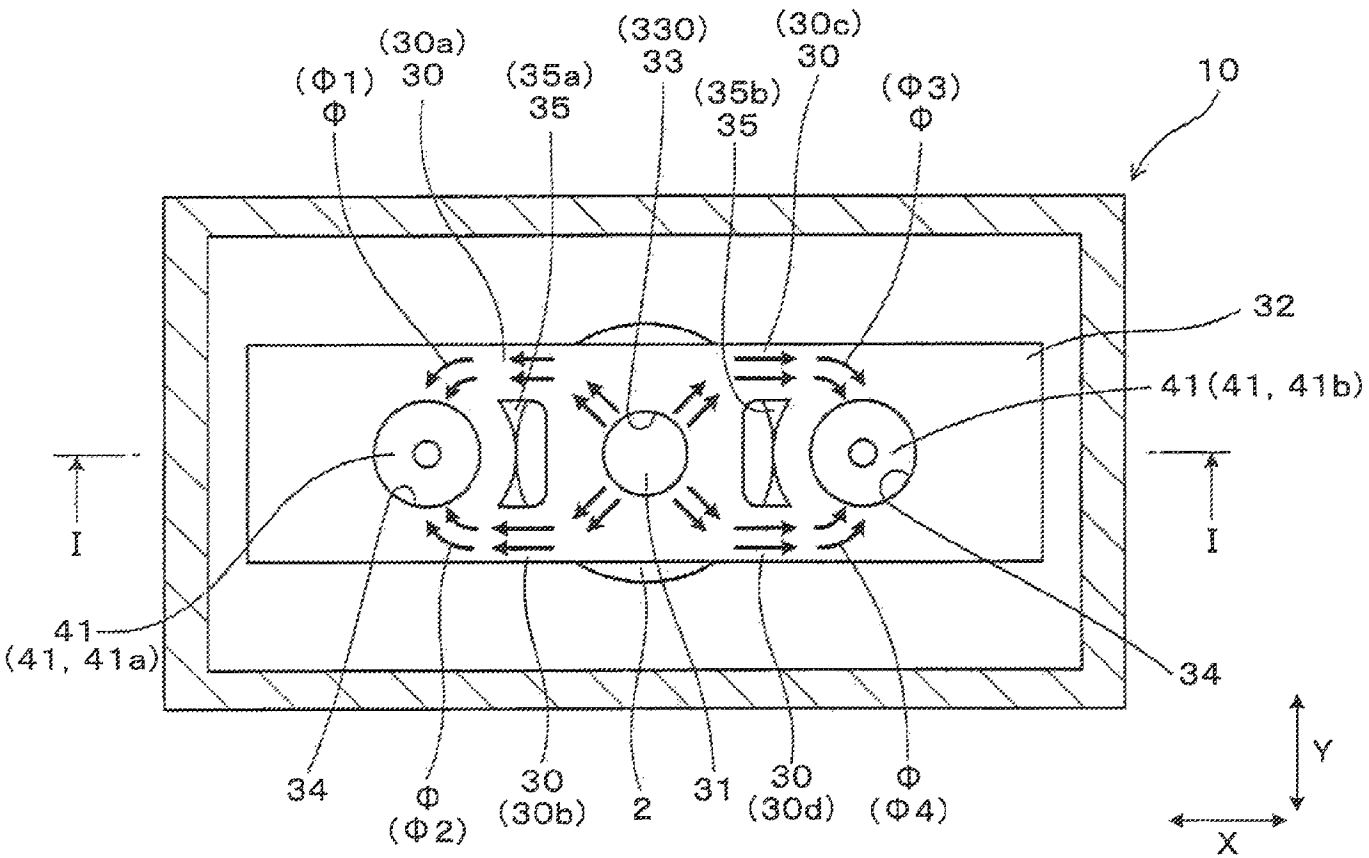
FIG. 3 is a cross section taken along line III-III of FIG. 2.

As illustrated in FIG. 3, in tie yoke 3, the magnetic saturation parts 30 in which magnetic saturation occurs locally are formed in a plurality of places. By the magnetic saturation parts 30, the amount of the magnetic flux Φ flowing in the plungers 4 is regulated.

In such a manner, when the magnetic flux Φ is passed, all of the plungers 4 can be reliably attracted by the attraction yokes 36. That is, in the case of magnetically connecting the plurality of plungers 4 in parallel like in the embodiment, there is a case that a part of the plungers 4 is attracted by the attraction yoke 36 faster than the other plungers 4. In this case, if the magnetic saturation parts 30 are not formed, a large amount of the magnetic flux Φ flows in the plunger 4 which is attracted earlier, so that the magnetic flux Φ to the other plungers 4 decreases. Consequently, the other plungers 4 are not easily attracted by the yoke 3.

However, by forming the magnetic saturation parts 30 in the plate-shaped yoke 3, the amount of the magnetic flux Φ flowing in each of the plungers 4 can be regulated. Consequently, even in the case where a part of the plungers 4 is attracted by the yoke 3 faster than the other plungers 4, the magnetic flux Φ can be passed also to the other plungers 4. As a result, the magnetic flux Φ can be sufficiently passed to all of the plungers 4, and all of the plungers 4 can be attracted by the attraction yoke 3.

It is also possible to generate a large magnetic flux Φ by the electromagnetic coil 2 and make the magnetic flux Φ saturated in the yoke 3 without forming the magnetic saturation parts 30. In this case, however, problems occur such that the size of the electromagnetic coil 2 becomes larger and power consumption increases. On the other hand, when the magnetic saturation parts 30 are formed like in the embodiment, the magnetic saturation can be easily brought about even with a small amount of the magnetic flux Φ, the electromagnetic coil 2 can be miniaturized, and power consumption can be also decreased.

Although the magnetic saturation parts 30 are formed in the yoke 3 in the embodiment, the magnetic saturation parts 30 may be formed in the plunger 4. For example, by notching a part of the core part 41, the magnetic saturation part 30 can be formed.

In the embodiment, as illustrated in FIG. 3, the through hole 35 is formed in a position adjacent to the plunger insertion hole 34 between the connection part 33 and the plunger insertion hole 34 in the plate-shaped yoke 32. The parts on both sides of the through hole 35 in the Y direction are the magnetic saturation parts 30.

With such a configuration, by the magnetic saturation parts 30, the amount of the magnetic flux Φ flowing in each of the plungers 4 can be regulated, and friction between the inner face of the plunger insertion hole 34 and the plunger 4 can be decreased.

That is, in the embodiment, since the though hole 35 is formed between the plunger 4 and the connection part 33, the magnetic flux Φ cannot flow in the through hole 35, is branched, and passes through the two magnetic saturation parts 30 existing near the plunger insertion hole 34. Consequently, the plunger 4 is not largely attracted by the connection part 33 side but is attracted by the two magnetic saturation parts 30 with small force. The force of attracting the plunger 4 by one of the two magnetic saturation parts 30 and that of attracting the plunger 4 by the other magnetic saturation part 30 are small and their directions are different from each other. Consequently, the plunger 4 can be prevented from being attracted by a large force in a specific direction. As a result, the plunger 4 does not slide with the inner face of the plunger insertion hole 34 with strong force, so that the friction which occurs between the inner face and the plunger 4 can be reduced.

As illustrated in FIG. 1, in the embodiment, two plungers 4 are disposed on the outside of the electromagnetic coil 2.

With the configuration, the number of plungers 4 disposed on the inside of the electromagnetic coil 2 can be decreased, so that the diameter of the electromagnetic coil 2 can be reduced, and the electromagnetic coil 2 can be miniaturized. In addition, the length of the conductive wire constructing the electromagnetic coil 2 can be shortened, and the manufacture cost of the electromagnetic coil 2 can be reduced.

As described above, according to the embodiment, the solenoid device in which even in the case where one of the plurality of plungers does not operate, the other plungers can reciprocate can be provided at lower manufacture cost.

Although the end of the pillar-shaped yoke 31 is fit in the yoke engagement hole 330 formed in the plate-shaped yoke 32 and the inner face of the yoke engagement hole 330 is used as the connection part 33 as illustrated in FIGS. 2 and 3 in the embodiment, the other configurations can be also employed. For example, without forming the yoke engagement hole 330, an end face 310 of the pillar-shaped yoke 31 may be in contact with the main face of the plate-shaped yoke 32. In this case, the part which comes into contact with the end face 310 of the pillar-shaped yoke 31, in the plate-shaped yoke 32 serves as the connection part 33.

Although the order of disposing the contact part 5, the plunger 4, and the attraction yoke 36 in the Z direction on the plunger 4*a* side and that on the other plunger 4*b* side are the same in the embodiment as illustrated in FIG. 1, another configuration may be employed. For example, the order of disposing the contact 5*a*, the plunger 4*a*, and the attraction yoke 36*b* in the Z direction is inverted. In such a manner, the contact part 5*a* enters the on state when the plunger 4*a* moves to an upper side in the diagram, and the other contact part 5*b* enters the on state when the plunger 4*b* moves to a lower side in the diagram. Consequently, it can prevent a situation that vibration is applied from the outside, the two plungers 4*a* and 4*b* move simultaneously in the same direction, and the two contact parts 5*a* and 5*b* are simultaneously turned on.

(Second Embodiment)

Figure 8:
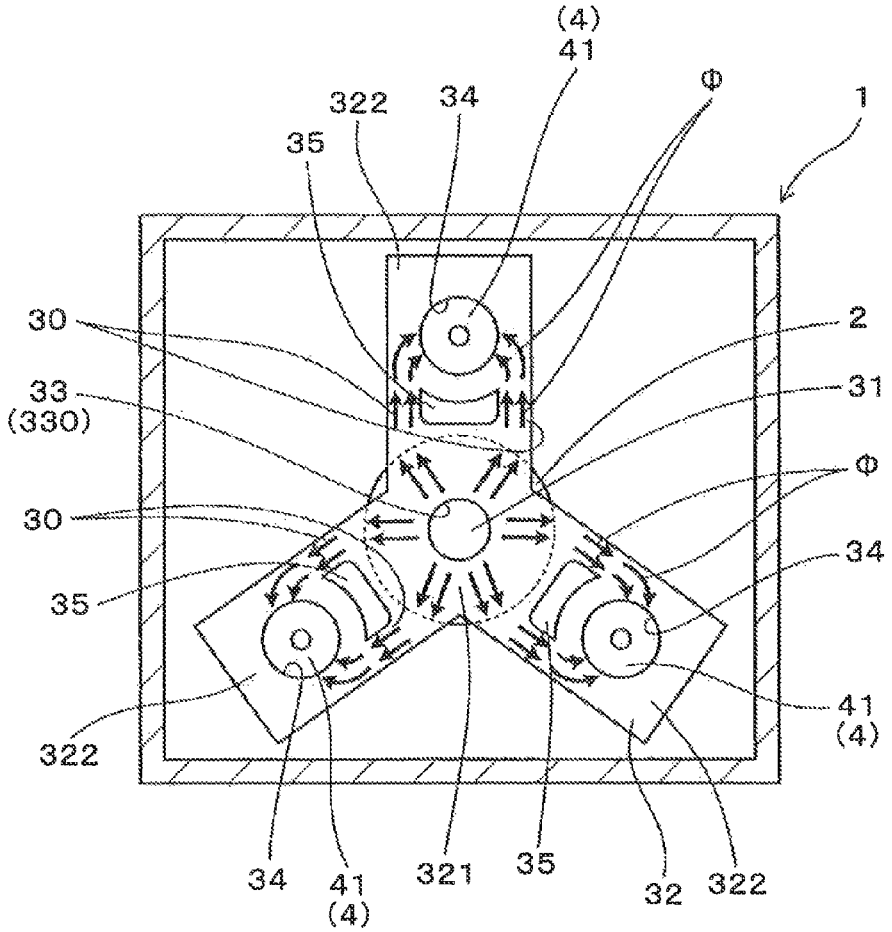
FIG. 8 is a transverse cross section of a solenoid device in a second embodiment.
Figure 9:
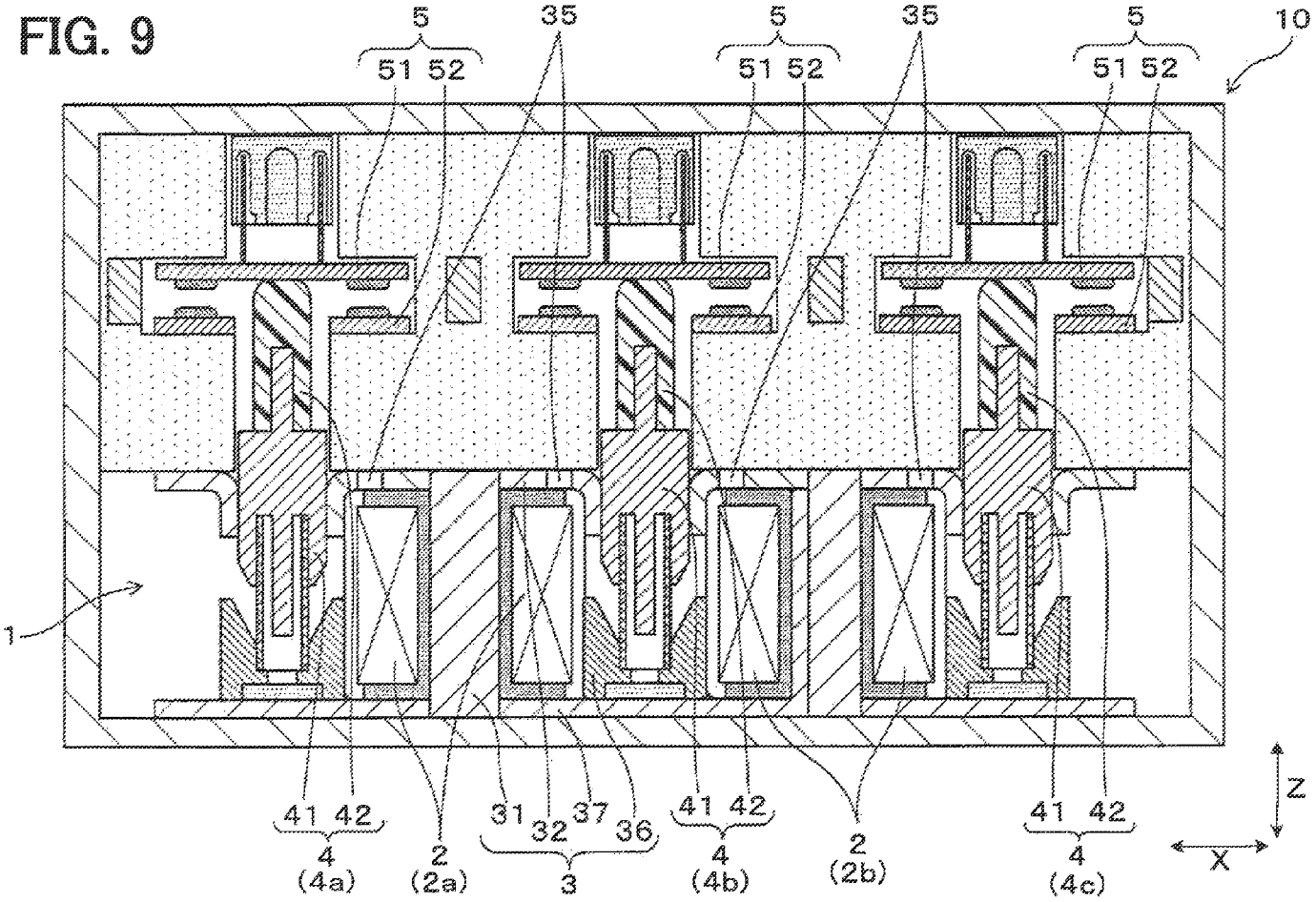
FIG. 9 is a vertical cross section of a solenoid device in a third embodiment.

In a second embodiment, the number of plungers 4 is changed. As illustrated in FIG. 8, the solenoid device 1 of the embodiment has one electromagnetic coil 2 and three plungers 4. The three plungers 4 are disposed on the outside in the radial direction of the electromagnetic coil 2 and formed so as to be able to reciprocate independently of one another. The plate-shaped yoke 32 has a center plate 321 having the yoke engagement hole 330 and three radial plates 322 spread radially from the center plate 321. The plunger insertion hole 34 is formed in each of the radial plates 322. The through hole 35 penetrating in the thickness direction of the plate-shaped yoke 32 is formed between the plunger insertion hole 34 and the yoke engagement hole 330 (connection part 33). At both ends of the through hole 35, the magnetic saturation parts 30 are formed.

The other configuration is similar to that of the first embodiment.

The effect of the embodiment will be described. In the embodiment, using one electromagnetic coil 2, the larger number (three) of plungers 4 can be made to reciprocate.

In addition, the second embodiment has other effects similar to those of the first embodiment.

(Third Embodiment)

In a third embodiment, the number of the electromagnetic coils 2 and the number of the plungers 4 are changed. The solenoid device 1 of the embodiment has two electromagnetic coils 2 and three plungers 4. The center axes of the two electromagnetic coils 2 and the center axes of the three plungers 4 are in parallel. An of the center axes exist in the same plane. An electromagnetic coil 2*a* as one of two electromagnetic coils 2*a* and 2*b* is disposed between a first plunger 4*a* and a second plunger 4*b*. The other electromagnetic coil 2*b* is disposed between a second plunger 4*b* and a third plunger 4*c*.

The third embodiment has configurations and effects similar to those of the first embodiment.

(Fourth Embodiment)

Figure 10:
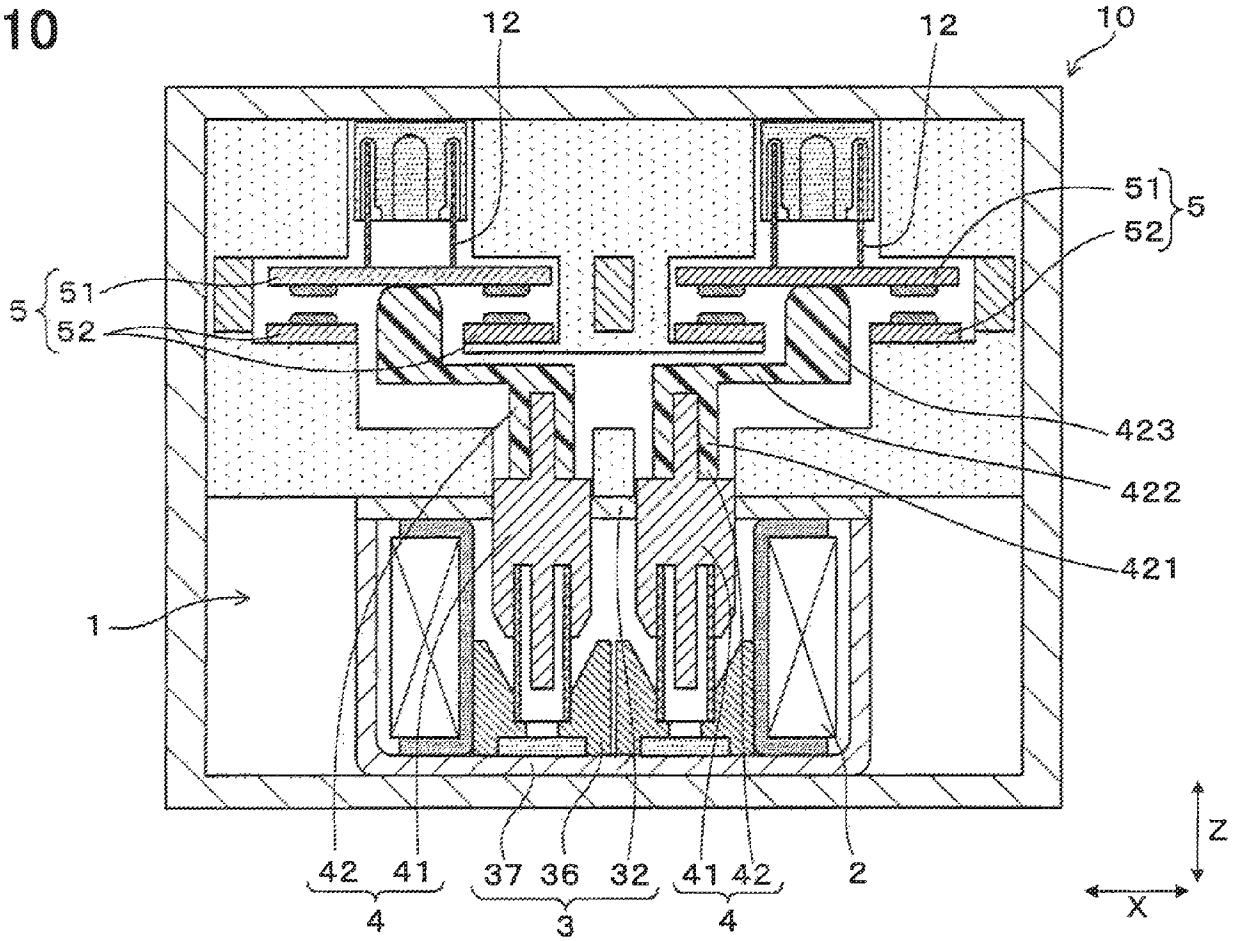
FIG. 10 is a vertical cross section of a solenoid device in a fourth embodiment.

In a fourth embodiment, the shape and the disposition position of the plunger 4 are changed. As illustrated in FIG. 10, in the embodiment, two plungers 4 are disposed in the center of one electromagnetic coil 2. The contact part 42 of each of the plungers 4 is bent. The contact part 42 has a first part 421 which is connected to the core part 41 and extends in the Z direction, a second part 422 extending from the first part 421 to the outside in the radial direction (X direction) of the electromagnetic coil 2, and a third part 423 extending from the second part 422 toward the moving-contact supporting part 51 in the Z direction. The third part 423 comes into contact with the moving-contact supporting part 51 in association with the reciprocating operation of the plunger 4.

The fourth embodiment has configurations and effects similar to those of the first embodiment (Fifth Embodiment)

Figure 11:
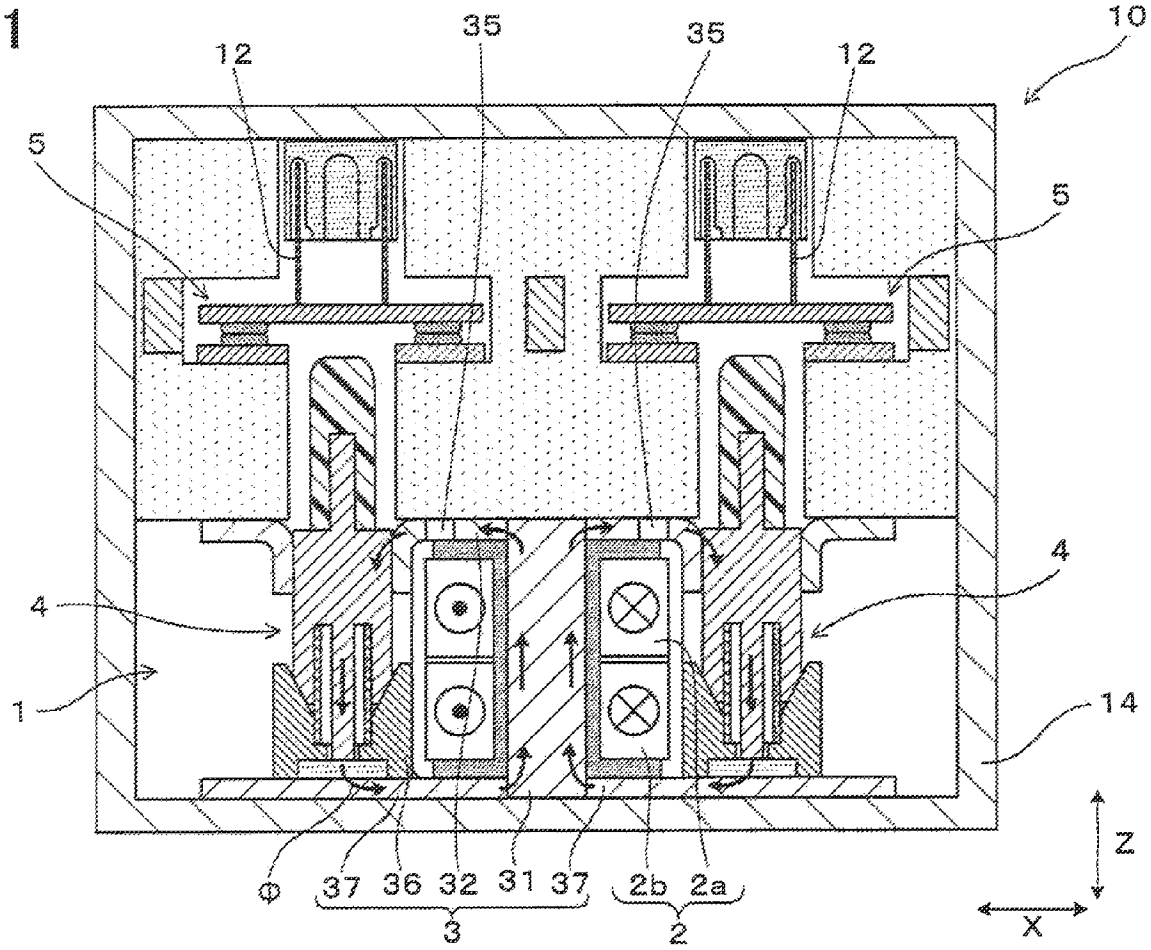
FIG. 11 is a cross section of a solenoid device in a state where current is passed to both of first and second parts of an electromagnetic coil in a fifth embodiment.

In a fifth embodiment, as illustrated in FIG. 11, the electromagnetic coil 2 is divided into two parts; a first part 2*a* and a second part 2*b*. The first and second parts 2*a* and 2*b* are obtained by winding a conductive wire so that the magnetic flux is generated in the same direction. Current can be passed separately to the first and second parts 2*a* and 2*b*. In the embodiment, at the time of attracting the plunger 4, current is passed to both of the first and second parts 2*a* and 2*b* of the electromagnetic coil 2. In such a manner, strong magnetic force is generated to attract the plunger 4.

The first and second parts 2*a* and 2*b* are disposed so as to be adjacent to each other in the Z direction in the movable range of the plunger 4. For example, in the case of dividing the electromagnetic coil 2 itself into a plurality of parts, if they are provided in the movable range of the plunger 4, they are the first and second parts 2*a* and 2*b* of one electromagnetic coil 2.

Figure 12:
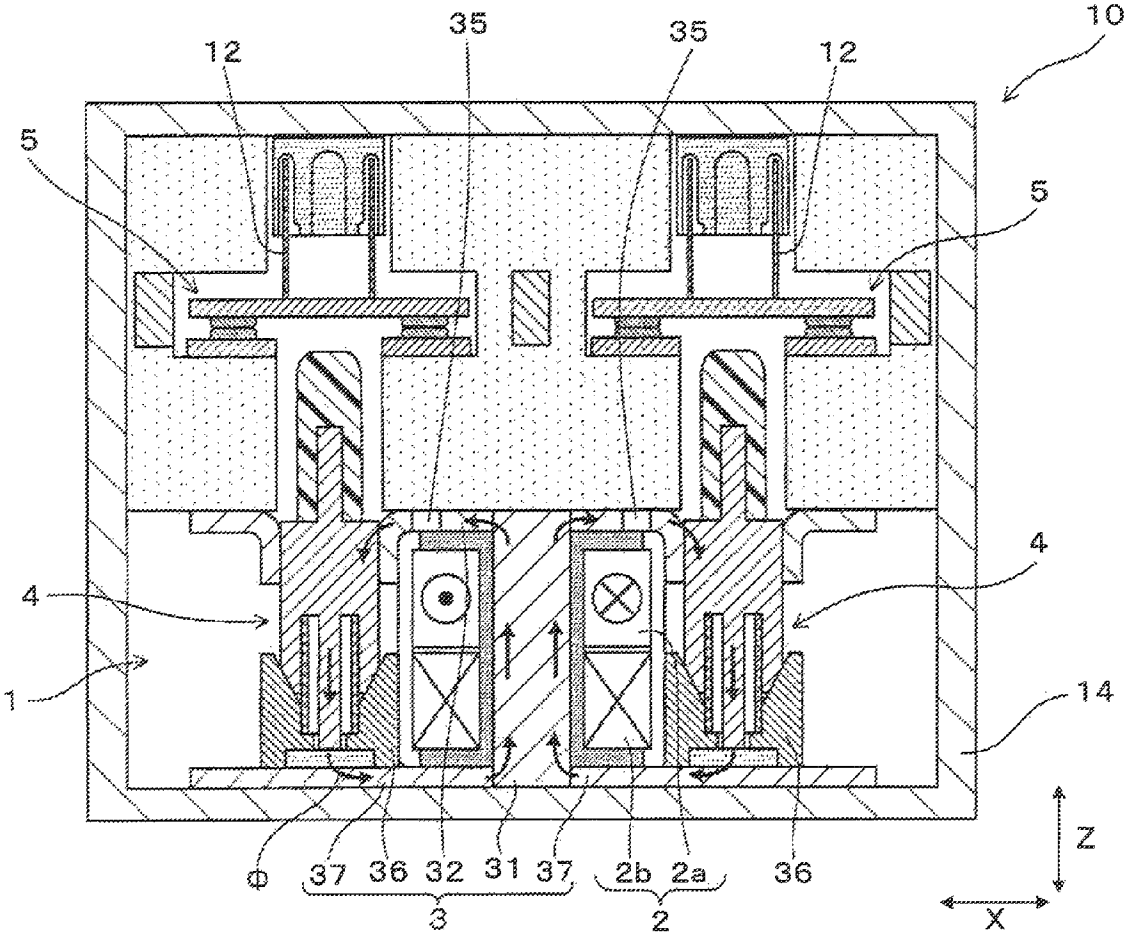
FIG. 12 is a cross section of the solenoid device in a state where current to the second part in the electromagnetic coil in the fifth embodiment is stopped.

In the embodiment, as illustrated in FIG. 12, after the plunger 4 is attracted, passage of current to the second part 2*b* is stopped and the plunger 4 is continued to be attracted by using only the first part 2*a*.

Before the plunger 4 is attracted, the gap between the plunger 4 and the attraction yoke 36 is large and magnetic resistance between the plunger 4 and the attraction yoke 36 is large, so that large magnetomotive force is necessary to attract the plunger 4. However, after the attraction, the air gap hardly exists, so that the magnetic resistance becomes very small. Consequently, a large magnetic flux $\Phi$ can be passed with small magnetomotive force. Even when passage of current to the second part 2*b* is stopped, the plunger 4 can be continuously attracted. Thus, the power consumption of the electromagnetic coil 2 can be reduced.

The fifth embodiment has configurations and effects similar to those of the first embodiment.

Although the electromagnetic coil 2 is divided into two parts of the first and second parts 2*a* and 2*b* in the embodiment, it may be divided into three or more parts.

Although the first and second parts 2*a* and 2*b* are formed by different conductive wires in the embodiment, they may be formed by using one conductive wire. For example, one conductive wire is wound to form the first and second parts 2*a* and 2*b* and current is passed to the midpoint of the first and second parts 2*a* and 2*b*. It can be constructed so that when voltage is applied across one of the ends of the conductive wire and the midpoint, the first part 2*a* is excited and, when voltage is applied across the other end of the conductive wire and the midpoint, the second part 2*b* is excited.

In the embodiment, a plunger 4 which can be attracted with low attraction force and a plunger 4 which requires stronger attraction force to be attracted can be provided. By passing current only to the first part 2*a* of the electromagnetic coil 2, only the plunger 4 which can be attracted with low attraction force is attracted. Subsequently, by passing current also to the second part 2*b*, the plunger 4 which requires strong attraction force is also attracted. In such a manner, the attraction order of a plurality of plungers 4 can be easily controlled. It is also possible to stop passage of current to the second part 2*b* after attracting two plungers 4 and, in a state where current is passed only to the first part 2*a*, both of the plungers 4 are continued to be attracted.

As a method of making the difference between the attraction forces for the plungers 4, for example, a method of forming the magnetic saturation part 30, making the spring constant of the pressing member 11 and that of the pressing member 12 different from each other, varying the gap between the plunger 4 and the attraction yoke 36, varying the mass of the plungers 4, and the like can be employed.

(Sixth Embodiment)

Figure 13:
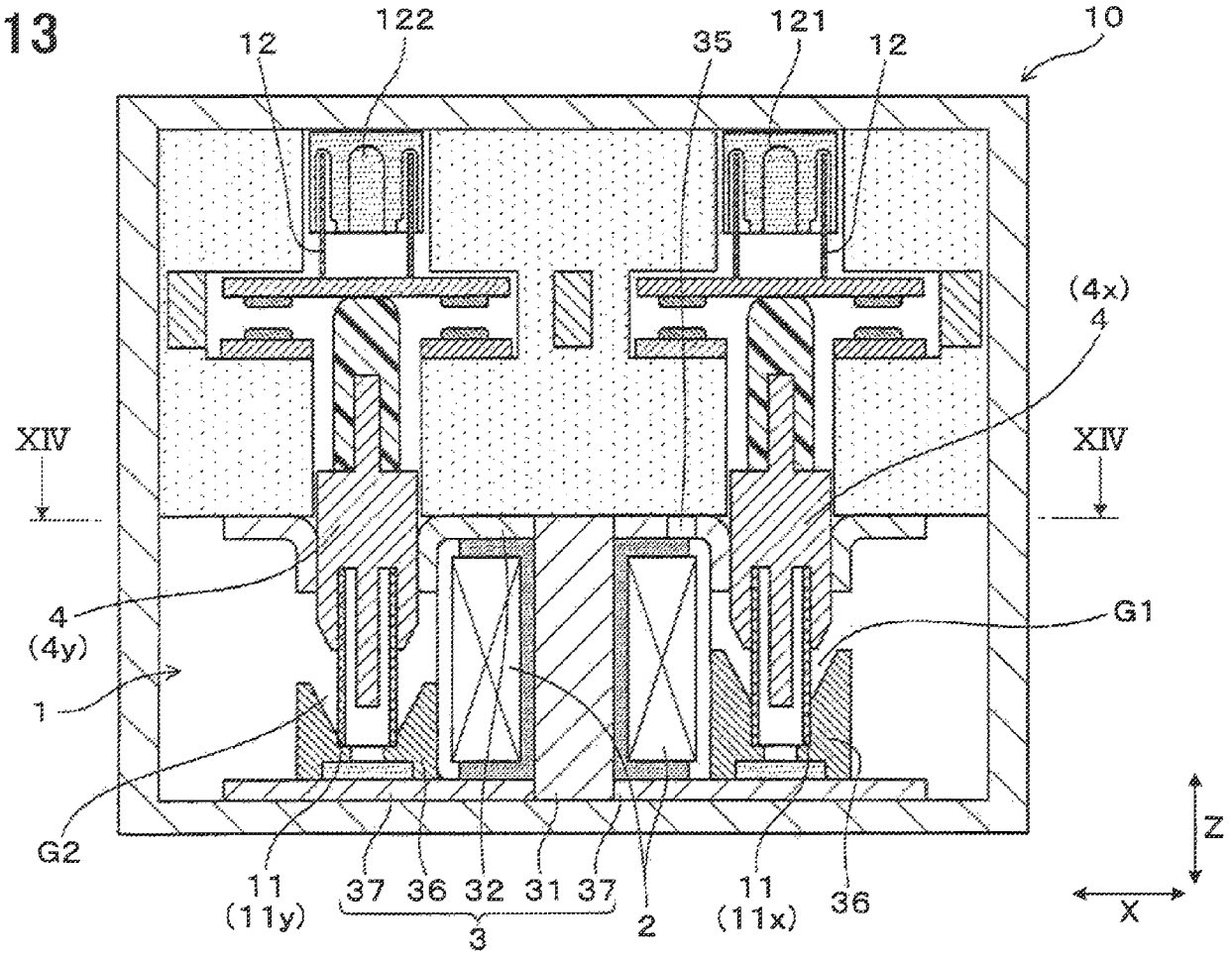
FIG. 13 is a cross section of a solenoid device in a sixth embodiment.

In a sixth embodiment, the shape of the plate-shaped yoke 32 is changed. The solenoid device 1 of the embodiment has two plungers 4 as illustrated in FIG. 13. The two plungers 4 are a first attraction plunger 4x and an afterward attraction plunger 4*y*. When current is passed to the electromagnetic coil 2, the first attraction plunger 4*x* is attracted first by the attraction yoke 36. After the first attraction plunger 4*x* is attracted, the afterward attraction plunger 4*y* is attracted by the attraction yoke 36.

In the embodiment, as illustrated in FIG. 13, the gap G1 between the first attraction plunger 4*x* and the attraction yoke 36 in a state where passage of current to the electromagnetic coil 2 is stopped is set to be smaller than the gap G2 between the afterward plunger 4*y* and the attraction yoke 36. Consequently, the magnetic force generated in the first attraction plunger 4*a* at the moment when current is passed to the electromagnetic coil 2 is larger than that generated in the afterward attraction plunger 4*y*. Therefore, the first attraction plunger 4*a* is attracted before the afterward attraction plunger 4*y*.

Figure 14:
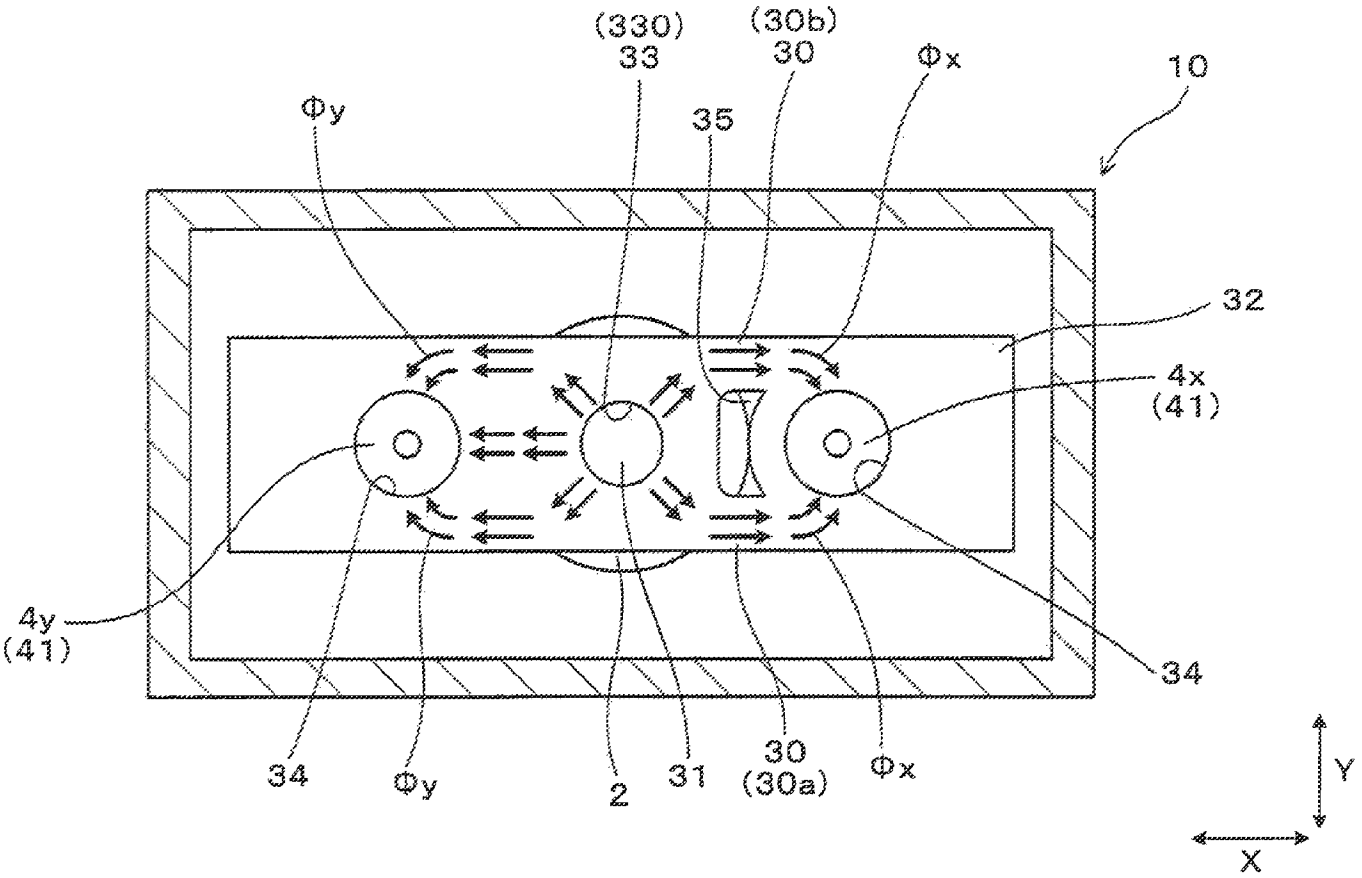
FIG. 14 is a cross section taken along line XIV-XIV of FIG. 13.

In the embodiment, as illustrated in FIG. 14, the magnetic saturation part 30 in which a magnetic flux Φx locally saturates is formed on the path of a magnetic flux Φx flowing in the first attraction plunger 4*x*. By the magnetic saturation part 30, the amount of the magnetic flux Φx flowing in the first attraction plunger 4*x* is regulated. The magnetic saturation part 30 is not formed on the path of a magnetic flux Φy flowing in the afterward attraction plunger 4*y*.

The effect of the embodiment will be described. In the embodiment, since the magnetic flux Φx flowing in the first attraction plunger 4*x* is regulated by the magnetic saturation part 30, after the first attraction plunger 4*x* is attracted, the magnetic flux Φy can be sufficiently passed also to the afterward attraction plunger 4*y*. Consequently, the afterward attraction plunger 4*y* can be attracted reliably.

It is also possible to generate a large magnetic flux Φ by the electromagnetic coil 2 and make the magnetic flux Φ saturated in the yoke 3 without forming the magnetic saturation part 30. In this case, however, problems occur such that the size of the electromagnetic coil 2 increases and power consumption increases. On the other hand, when the magnetic saturation part 30 is formed in a manner similar to the embodiment, the magnetic saturation can be easily brought about even with small magnetic flux Φ, the electromagnetic coil 2 can be miniaturized, and power consumption can be also reduced.

In the embodiment, the two plungers 4*x* and 4*y* can be attracted with a time difference, operation sound can be reduced.

The other configuration is similar to that of the first embodiment.

Figure 15:
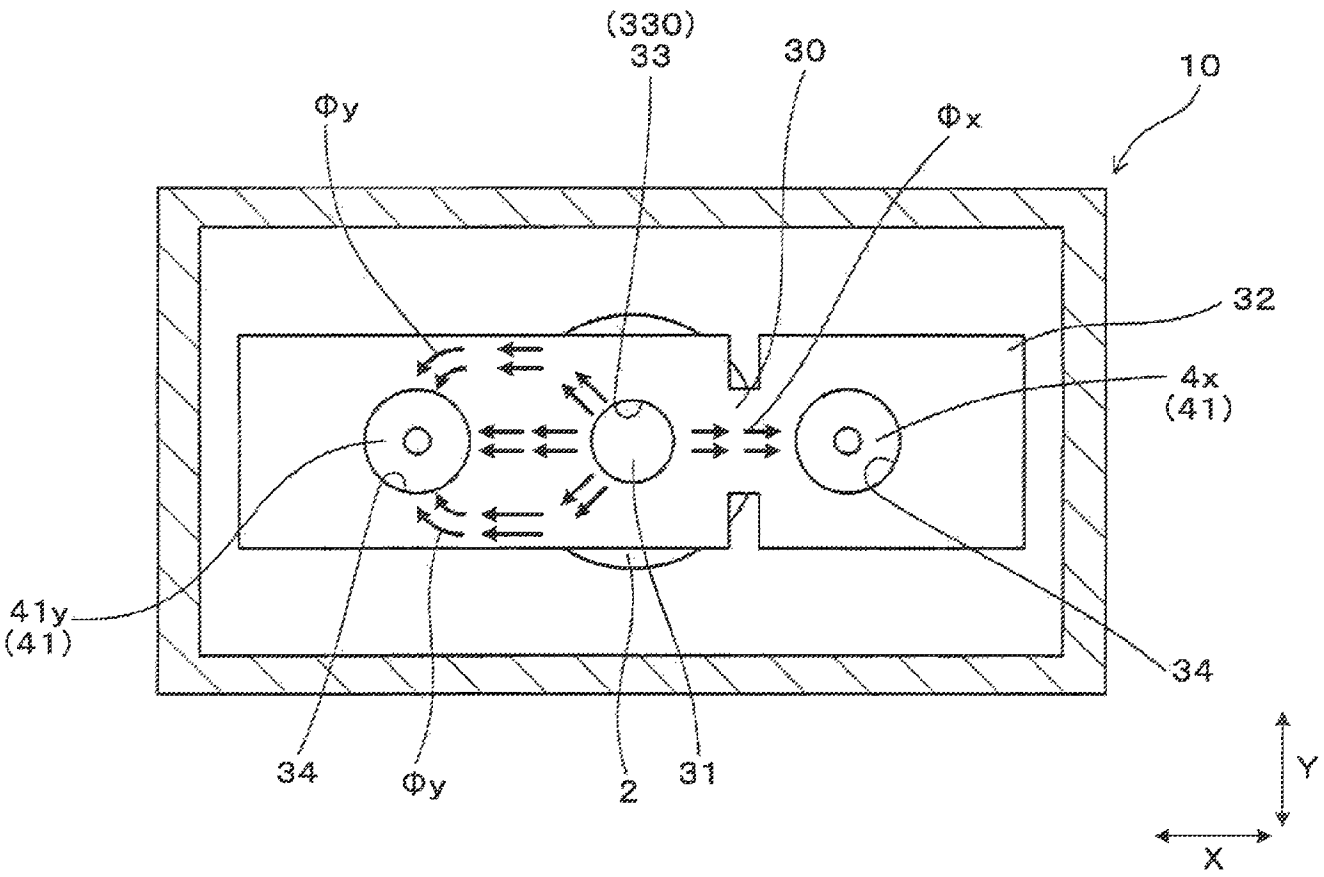
FIG. 15 is a plan view of a plate-shaped yoke in which a magnetic saturation part is formed in one place in the sixth embodiment.

In the embodiment, as illustrated in FIG. 14, two magnetic saturation parts 30 (30*a* and 30*b*) are formed. Alternatively, one magnetic saturation part 30 may be formed by notching both sides in the Y direction of the plate-shaped yoke 32 as illustrated in FIG. 15. Although not illustrated, one magnetic saturation part 30 may be formed in the first attraction plunger 4*x*.

In the embodiment, by changing the length of the gaps G1 and G2 as illustrated in FIG. 13, the first attraction plunger 4*x* is attracted before the afterward attraction plunger 4*y*. It is also possible to make the mass of the plunger 4*x* and that of the plunger 4*y* different from each other or make the spring constant of the plunger pressing member 11*x* and that of the plunger pressing member 11*y* different from each other. An elastic member (not illustrated) may be provided between the attraction yoke 36 and the plunger pressing member 11 to make the spring constant of the elastic member on the side of the first attraction plunger 4*x* and the spring constant of the elastic member on the side of the afterward attraction plunger 4*y* different from each other. It is also possible to form fixing members 121 and 122 for fixing the contact pressing member 12 by elastic material and make the elastic moduli of the two fixing members 121 and 122 different from each other.

(Seventh Embodiment)

Figure 16:
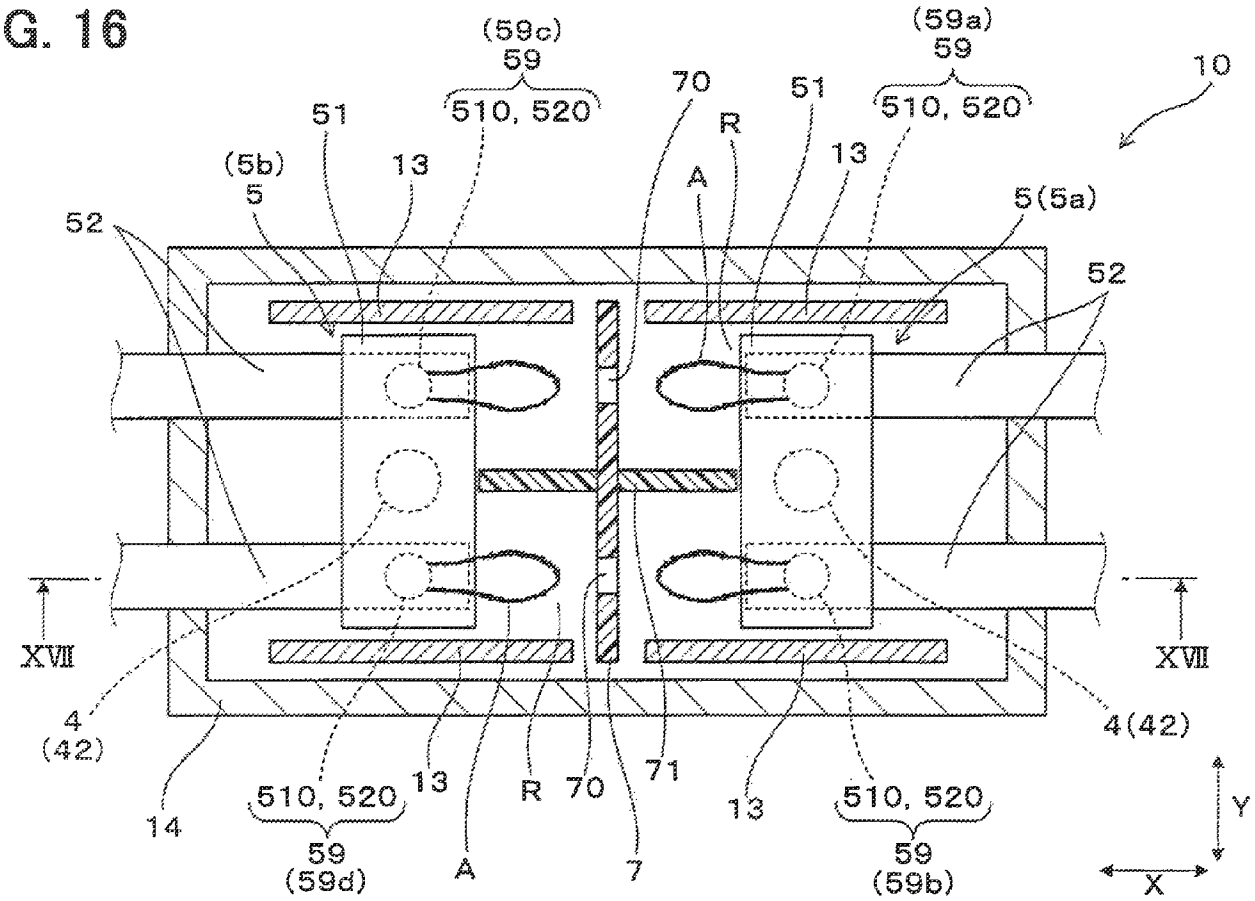
FIG. 16 is a cross section of an electromagnetic relay in a seventh embodiment.
Figure 17:
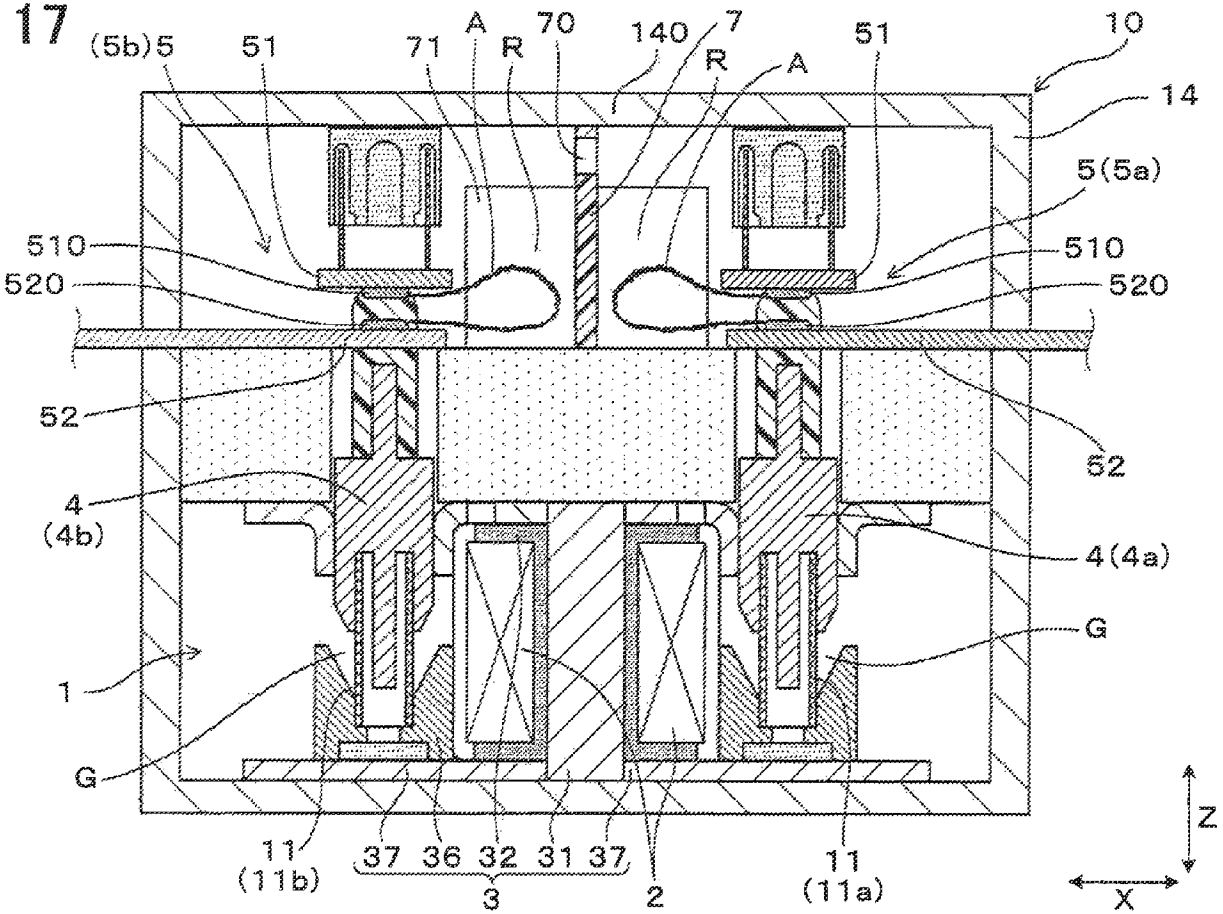
FIG. 17 is a cross section taken along line XVII-XVII of FIG. 16.

In a seventh embodiment, an arc contact preventing plate 7 made of insulating material is disposed between two contact parts 5 (5*a* and 5*b*) as illustrated in FIGS. 16 and 17. When the contact part 5 is switched from the off state to the on state, an arc A is generated. In the embodiment, by using the arc contact preventing plate 7, the arcs A are prevented from coming into contact with each other.

In a manner similar to the first embodiment, the contact part 5 has the moving contact 510, the fixed contact 520, the moving-contact supporting part 51 for supporting the moving contact 510, and the fixed-contact supporting part 52 for supporting the fixed contact 520. One contact part 5 has two fixed-contact supporting parts 52 and one moving-contact supporting part 51. The arc A is generated from a pair (contact pair 59) of the moving contact 510 and the fixed contact 520. One contact part 5 has two contact pairs 59. Two contact pairs 59*a* and 59*b* included in the contact part 5*a* as one of the contact parts 5*a* and two contact pairs 59*c* and 59*d* included in the other contact part 5*b* are opposed to each other in the X direction.

The main face of the arc contact preventing plate 7 is orthogonal to the X direction. An arc extinction room R is formed between the arc contact preventing plate 7 and the contact part 5. The arc A is led to the arc extinction room R by the magnetic force of the arc-extinction magnet 13 provided near the contact part 5, extended, and extinguished. In the arc contact preventing plate 7, the through hole 70 penetrating in the X direction is formed. As illustrated in FIG. 17, the through hole 70 is formed near the upper wall 140 of the casing 14.

The electromagnetic relay 10 of the embodiment has an auxiliary arc contact preventing plate 71 made of insulating material. The auxiliary arc contact preventing plate 71 prevents two arcs generated from a single contact part 5 from coming into contact with each other.

In the embodiment, as illustrated in FIG. 17, in a state where passage of current to the electromagnetic coil 2 is stopped (current passage stop state), the plungers 4*a* and 4*b* can swing in the reciprocating directions (Z directions). The spring constant of the plunger pressing member 11*a* of the plunger 4*a* and that of the plunger pressing member 11*b* of the other plunger 4*b* are different from each other. Consequently, the frequency of vibrations in the Z directions in the current passage stop state of the two plungers 4*a* and 4*b* are different from each other.

The other configuration is similar to that of the first embodiment.

The effects of the embodiment will be described. Like in the embodiment, when the through hole 70 is formed in the arc contact preventing plate 7, the arc A can be extinguished fast. That is, a part of the metal constructing the moving contact 510 and the fixed contact 520 evaporates due to the heat of the arc A, and metallic vapor is generated. When the concentration of the metallic vapor becomes high in the space in which the arc A is generated (extinction room R), the arc A is not easily extinguished. The generation amount of the metallic vapor varies depending on the contact part 5. Consequently, when the through hole 70 is formed in the arc contact preventing plate 7, the metallic vapor can be moved via the through hole 70 from the extinction room R in which the concentration of the metallic vapor is high to the extinction room R in which the concentration is low. Therefore, local increase in the concentration of the metallic vapor can be suppressed, and the arc can be extinguished soon.

In the embodiment, the frequencies of vibrations in the Z directions of the two plungers 4*a* and 4*b* in the current passage stop state are made different from each other.

In the case where the frequencies of vibrations of a plurality of plungers 4 are equal to one another, the plurality of plungers 4 simultaneously move in the same direction by the vibrations, and a plurality of contact parts 5 are turned on at the same time. Due to this, an inconvenience such that an electronic device (the inverter 61, refer to FIG. 7) connected to the electromagnetic device 10 operates at unexpected time occurs. Consequently, by making the frequencies of vibrations of the plungers 4 different from one another, the plurality of contact parts 5 are prevented from turning on at the same time, and the inconvenience can be prevented.

In the embodiment, by making the spring constants of the plunger pressing members 11*a* and 11*b* different from each other, the frequencies of vibrations of the two plungers 4*a* and 4*b* are made different. Alternatively, the masses of the plungers 4*a* and 4*b* may be made different from each other or the length of the gap G between the plunger 4*a* and the attraction yoke 36 and that of the gap G between the plunger 4*b* and the attraction yoke 36 may be made different from each other.

The seventh embodiment has other effects similar to those of the first embodiment.

(Eighth Embodiment)

Figure 18:
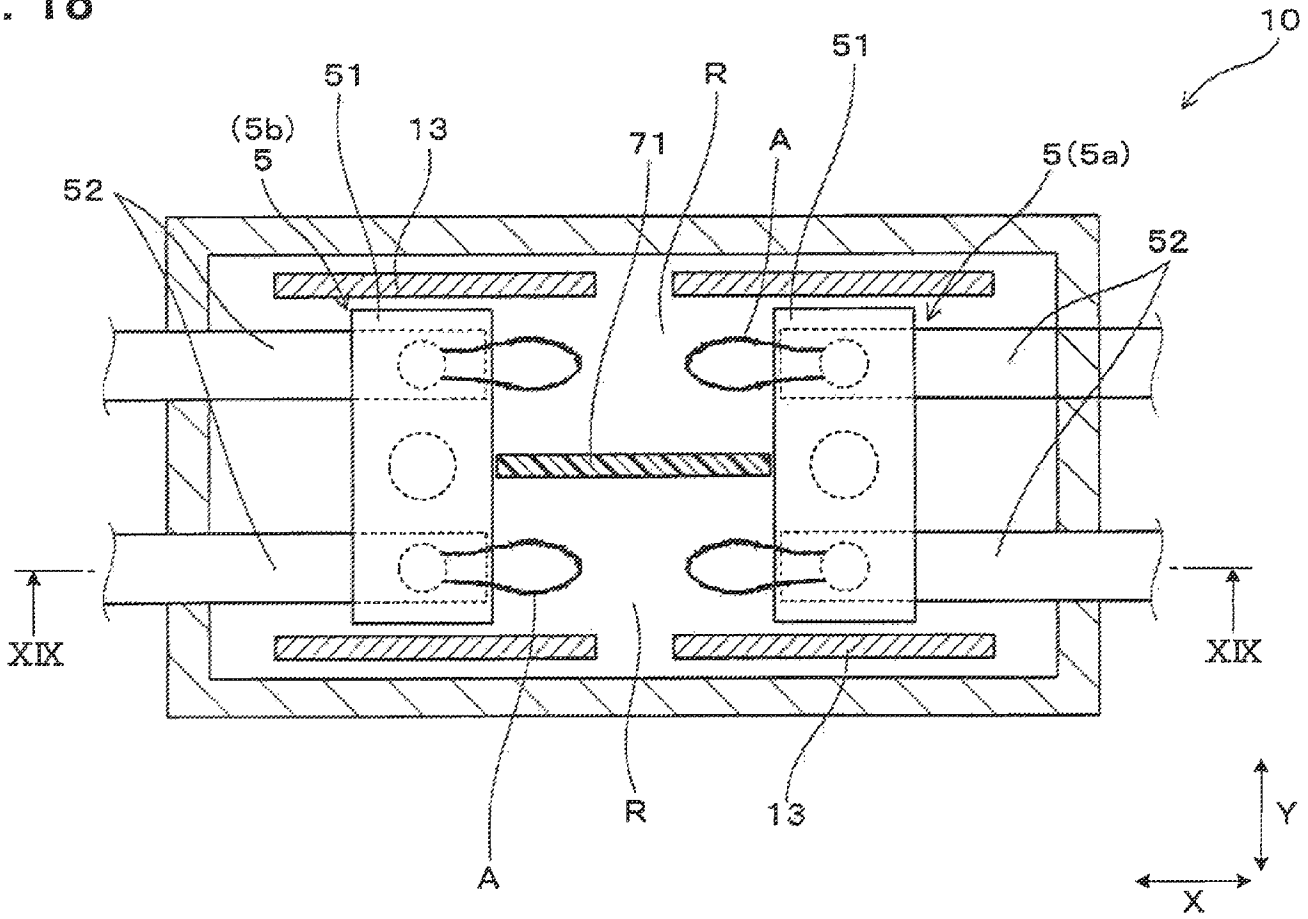
FIG. 18 is a cross section of an electromagnetic relay in an eighth embodiment.
Figure 19:
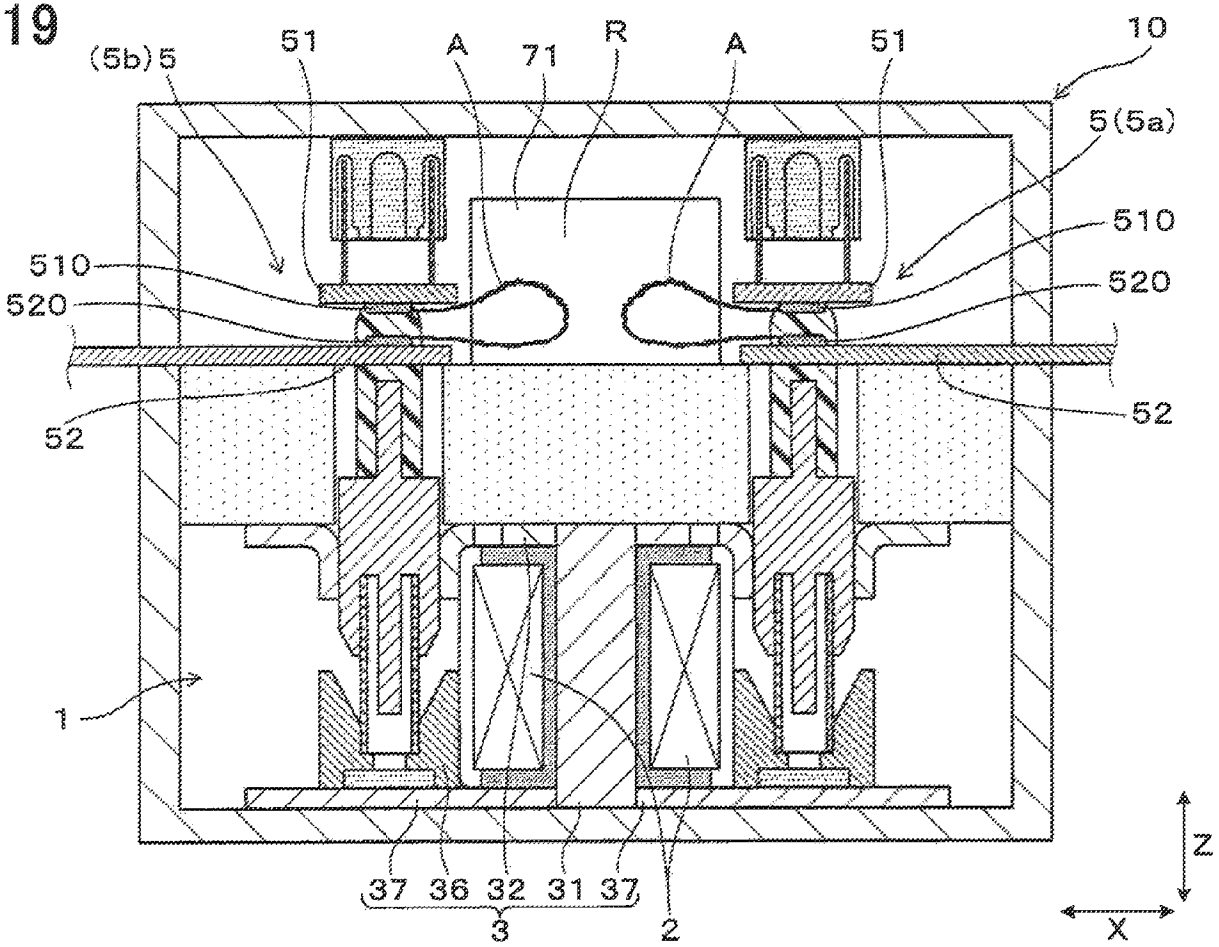
FIG. 19 is a cross section taken along line XIX-XIX of FIG. 18.

In an eighth embodiment, the arc contact preventing plate 7 is not provided as illustrated in FIGS. 18 and 19. In the embodiment, the two contact parts 5*a* and 5*b* are sufficiently apart from each other in the X direction so that the arcs A do not come into contact with each other.

The generation amount of the metallic vapor varies depending on the contact part 5. In the embodiment, since the arc contact preventing plate 7 is not provided, metallic vapor can be smoothly moved from the contact part 5 in which the generation amount of metallic vapor is large to the contact part 5 in which the generation amount is small. Consequently, the concentration of the metallic vapor can be prevented from locally increasing, and the arc A can be extinguished promptly.

The eighth embodiment has other effects similar to those of the seventh embodiment.

(Ninth Embodiment)

Figure 20:
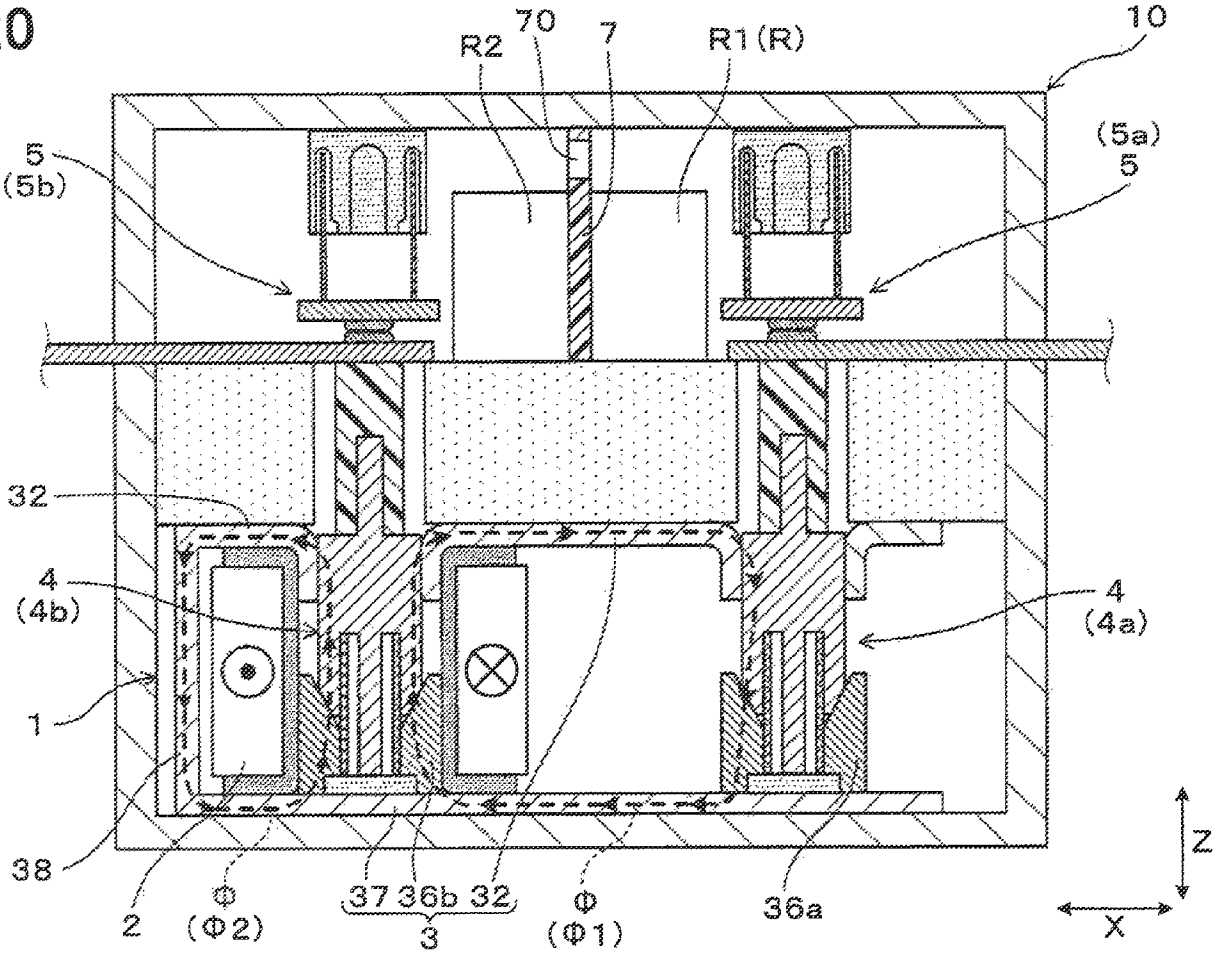
FIG. 20 is a cross section of an electromagnetic relay in a state where current is passed to an electromagnetic coil in a ninth embodiment.
Figure 21:
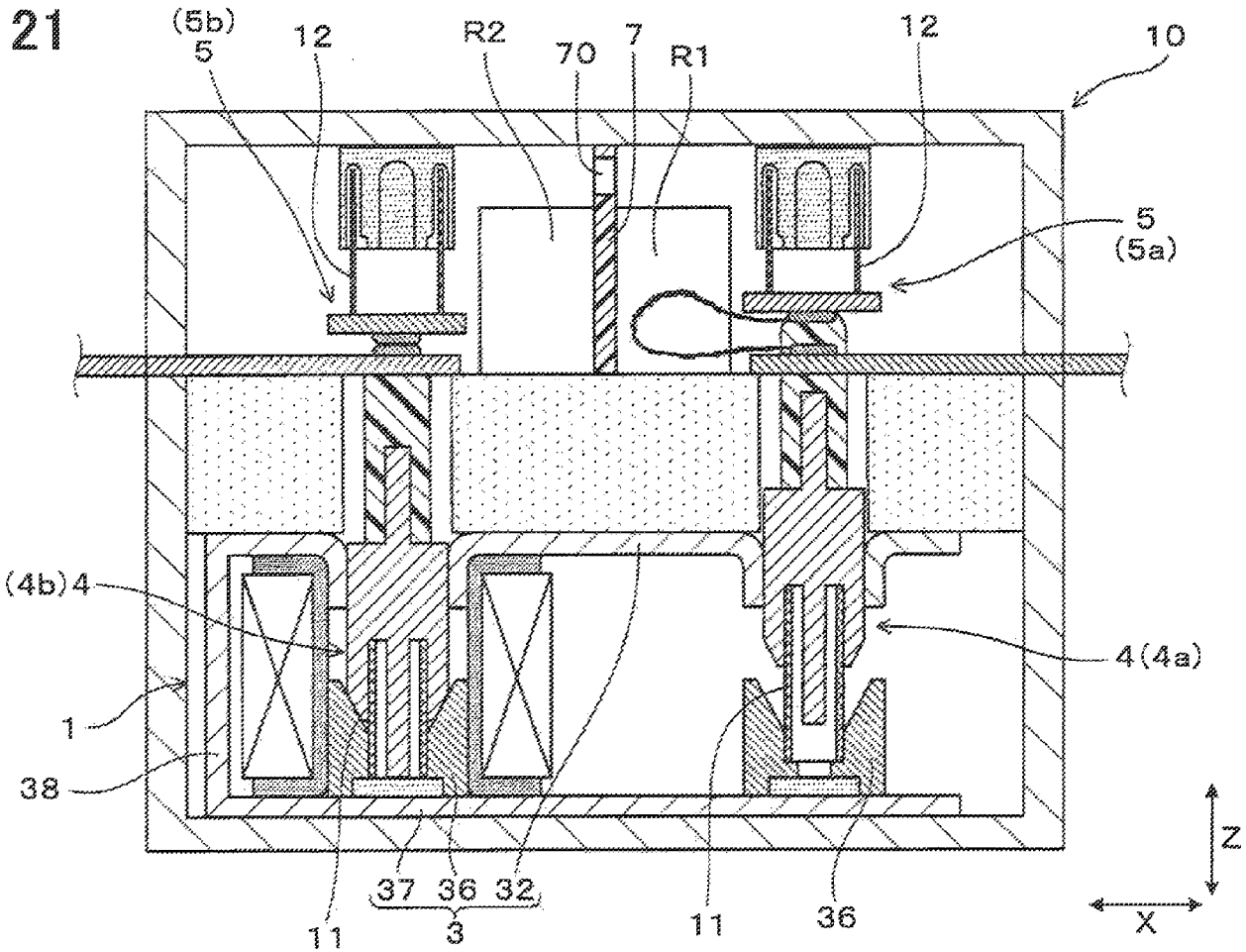
FIG. 21 is a cross section of the electromagnetic relay immediately after current to the electromagnetic coil in the ninth embodiment is stopped.
Figure 22:
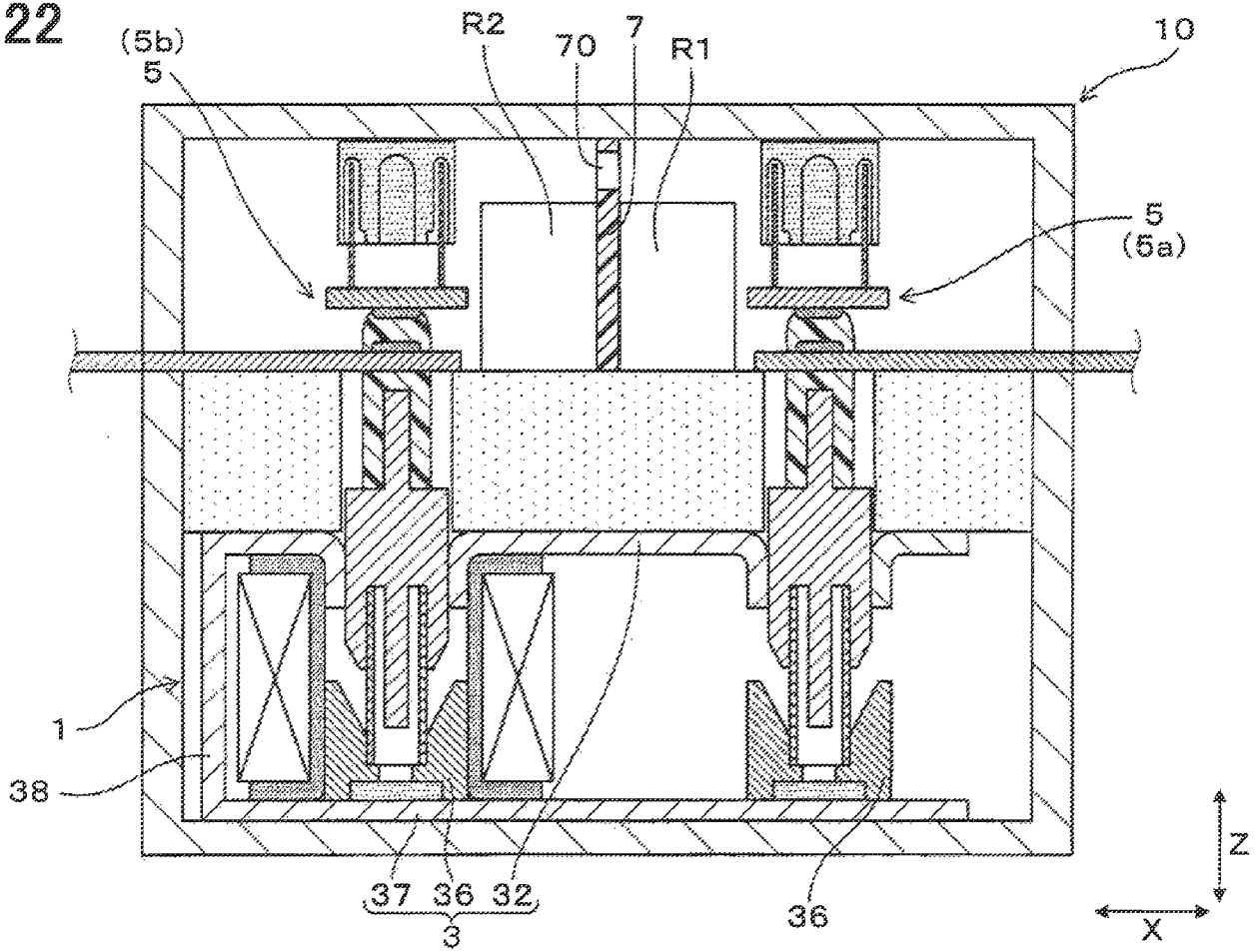
FIG. 22 is a cross section of the electromagnetic relay in a state after lapse of some time since current to the electromagnetic coil in the ninth embodiment is stopped.

In a ninth embodiment, the two contact parts 5 are switched from the on state to the off state in predetermined order as illustrated in FIGS. 20 to 22. The electromagnetic relay 10 of the embodiment interrupts the current by using only the contact part 5*a* as one of the contact parts in a manner similar to the first embodiment (refer to FIG. 7), and the other contact part 5*b* is used as a fail-safe. The contact part 5*a* for current cutoff is switched first from the on state to the off state and, after that, the contact part 5*b* for a fail-safe is switched from the on state to the off state.

In the embodiment, in a manner similar to the seventh embodiment, the arc contact preventing plate 7 is disposed between the two contact parts 5. A through hole 70 is provided in the arc contact preventing plate 7.

The plunger 4*a* as one of the two plungers 4*a* and 4*b* is disposed on the outside of the electromagnetic coil 2. The other plunger 4*b* is disposed on the inside of the electromagnetic coil 2. A side-wall yoke 38 is provided near the electromagnetic coil 2. By the side-wall yoke 38, the plate-shaped yoke 32 and the bottom yoke 37 are connected.

As illustrated in FIG. 20, when current is passed to the electromagnetic coil 2, the magnetic flux Φ is generated. The magnetic flux Φ is split to a first magnetic flux Φ1 and a second magnetic flux Φ2, and the magnetic fluxes Φ1 and Φ2 flow. The first magnetic flux Φ1 flows in the plate-shaped yoke 32, the plunger 4*a*, an attraction yoke 36*a*, the bottom yoke 37, an attraction yoke 36*b*, and the other plunger 4*b*. The second magnetic flux Φ2 flows in the other plunger 4*b*, the plate-shaped yoke 32, the side-wall yoke 38, the bottom yoke 37, and the attraction yoke 36*b*.

In such a manner, only the first magnetic flux Φ1 flows in the plunger 4*a*, and both of the first and second magnetic fluxes Φ1 and Φ2 flow in the other plunger 4*b*. Consequently, the amount of the magnetic flux flowing in the other plunger 4*b* is large, and strong magnetic force is generated. On the other hand, the amount of the magnetic flux flowing in the plunger 4*a* is small, and only weak magnetic force is generated. Consequently, as illustrated in FIG. 21, when passage of current to the electromagnetic coil 2 is stopped, attraction of the plunger 4*a* of weak magnetic force to be attracted is cancelled first.

Specifically, when passage of current to the electromagnetic coil 2 is stopped, the force of attracting the plunger 4 by the attraction yoke 36 gradually decreases and, at the time point when the attraction force becomes smaller than the total force of the two pressing members 11 and 12, the attraction of the plunger 4 is cancelled. In the embodiment, since the attraction force of the plunger 4*a* is weaker, when passage of current to the electromagnetic coil 2 is stopped, the attraction force of the plunger 4*a* becomes smaller than the total force more quickly as compared with the attraction force of the other plunger 4*b*. Consequently, the attraction of the plunger 4*a* is cancelled first.

By cancellation of the attraction of the plunger 4*a*, the contact part 5*a* is turned off. After that, as illustrated in FIG. 22, attraction of the other plunger 4*b* having strong magnetic force to be attracted is also cancelled, and the other contact part 5*b* is turned off.

The other configuration is similar to that of the first embodiment.

The effects of the embodiment will be described. In the embodiment, current is interrupted using only the contact part 5*a* (refer to FIG. 7) as a part of the plurality of contact parts 5*a* and 5*b*, and the other contact part 5*b* is used as a fail-safe. The contact part 5*a* for current cutoff is switched first from the on state to the off state and, after that, the contact part 5*b* for a fail-safe is switched from the on state to the off state. In this case, when the contact part 5*a* for current cutoff is switched from the on state to the off state, an arc and metallic vapor are generated. However, no arc and no metallic vapor are generated from the contact part 5*b* for a fail-safe. Consequently, when the through hole 70 is provided in the arc contact preventing plate 7 as described above, metallic vapor generated from the contact part 5*a* for current cutoff can be moved to the contact part 5*b* for a fail-safe (contact part from which no metallic vapor is generated via the through hole 70. Therefore, the concentration of the metallic vapor in the periphery of the contact part 5*a* for current cutoff can be effectively decreased. As a result, the arc can be extinguished more quickly.

In the embodiment, in a state where the two plungers 4 are attracted, the amounts of the magnetic fluxes Φ flowing in the plungers 4 are different from each other. As illustrated in FIGS. 21 and 22, in the case where passage of current to the electromagnetic coil 2 is stopped, attraction is cancelled in order from the plunger 4 to which the amount of the magnetic flux Φ in a state of attraction is small. By the operation of cancelling the attraction of the plunger 4, the contact part 5 is switched from the on state to the off state.

In such a manner, the attraction of the plungers 4*a* and 4*b* can be reliably cancelled in predetermined order. Consequently, by the operation of cancelling the attraction of the plungers 4*a* and 4*b*, the two contact parts 5*a* and 5*b* can be reliably set to the off state in predetermined order.

Although the voltage applied to the electromagnetic coil 2 is decreased to 0V at once at the time of stopping passage of current to the electromagnetic coil 2 in the embodiment, the voltage applied to the electromagnetic coil 2 can be decreased step by step.

When the voltage of the electromagnetic coil 2 is decreased step by step, the magnetic force generated in each of the plungers 4 decreases step by step. Therefore, the attraction of the plurality of plungers 4 can be cancelled more reliably in order from the plunger 4 having the small amount of the magnetic flux at the time of attraction (the plunger 4 having weak magnetic force to be attracted. Therefore, the plurality of contact parts 5 can be reliably set to the off state in predetermined order.

In the embodiment, the plunger 4*a* as one of the two plungers 4 is disposed on the outside of the electromagnetic coil 2, and the other plunger 4*b* is disposed on the inside of the electromagnetic coil 2.

With the configuration, the number of plungers 4 disposed on the inside of the electromagnetic coil 2 can be decreased, so that the diameter of the electromagnetic coil 2 can be reduced, and the electromagnetic coil 2 can be miniaturized. In addition, the length of the conductive wire constructing the electromagnetic coil 2 can be shortened, and the manufacture cost of the electromagnetic coil 2 can be reduced.

By disposing the other plunger 4*b* on the inside of the electromagnetic coil 2, when current is passed to the electromagnetic coil 2, larger amount of the magnetic flux Φ can be passed to the other plunger 4*b*. Therefore, when current is passed to the electromagnetic coil 2, the other plunger 4*b* can be attracted first.

In the embodiment, at the time of switching the off state to the on state, the other plunger 4*b* in which stronger magnetic force is generated is attracted first and, after that, the plunger 4*a* is attracted. Therefore, the two plungers 4*a* and 4*b* can be attracted with a time lag, and operation sound can be reduced.

The embodiment has other effects similar to those of the first embodiment.

Figure 23:
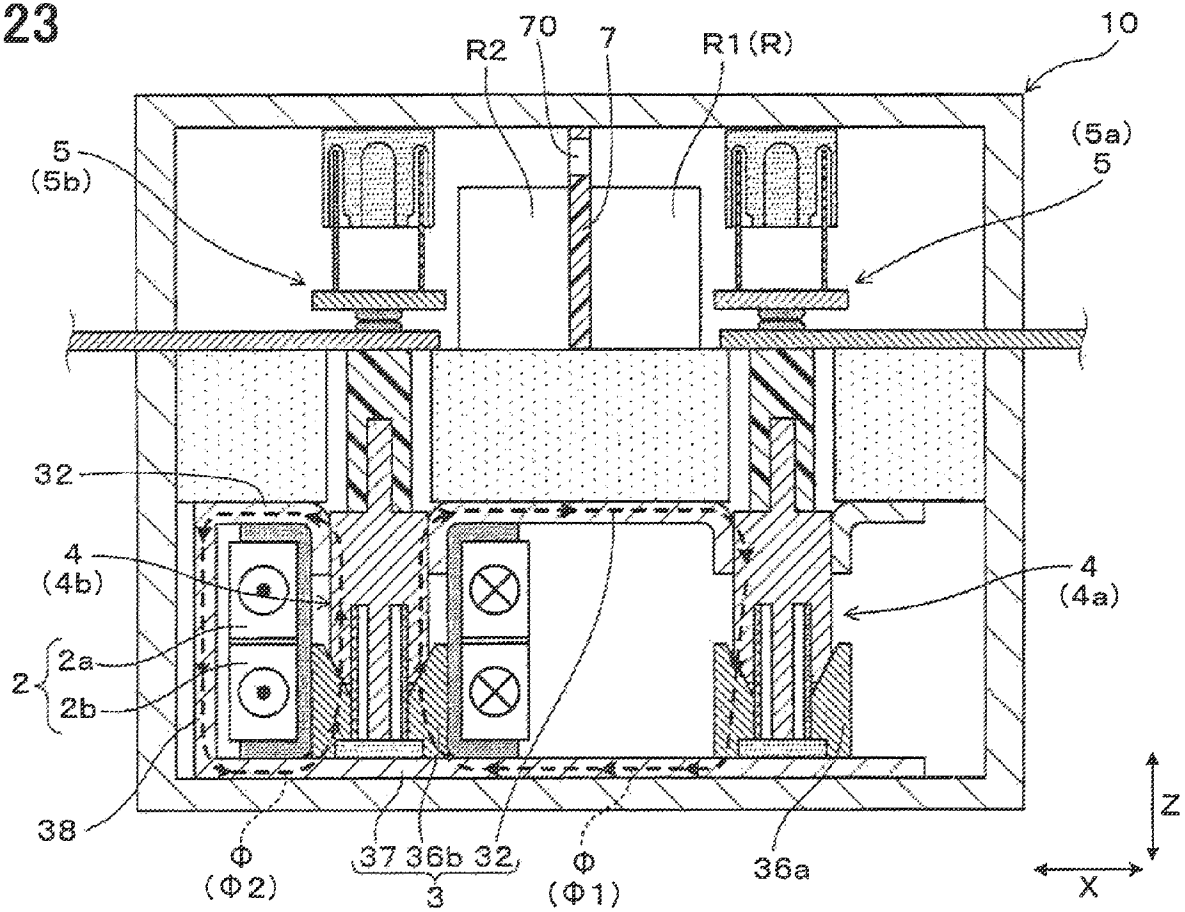
FIG. 23 is a diagram illustrating an example of dividing the electromagnetic coil in the ninth embodiment into a plurality of parts.

The electromagnetic coil 2 can be divided into two parts; the first part 2*a* and the second part 2*b* as illustrated in FIG. 23. At the time of attracting the plunger 4, current is passed to each of the two parts 2*a* and 2*b*. After the plunger 4 is attracted, for example, passage of current to the second part 2*b* is stopped and, in a state where current is passed only to the first part 2*a*, the two plungers 4*a* and 4*b* can be continuously attracted. In such a manner, power consumption of the electromagnetic coil 2 can be reduced.

The definition of the first and second parts 2*a* and 2*b* is similar to that in the fifth embodiment. The electromagnetic coil 2 may be divided into three or more parts.

The two plungers 4*a* and 4*b* may be continuously attracted in a state where current is passed to each of the first and second parts 2*a* and 2*b*. When passage of current to the second part 2*b* is stopped, attraction of the plunger 4*a* may be cancelled and, when passage of current to the first part 2*a* is stopped, attraction of the other plunger 4*b* may be also cancelled.

(Tenth Embodiment)

Figure 24:
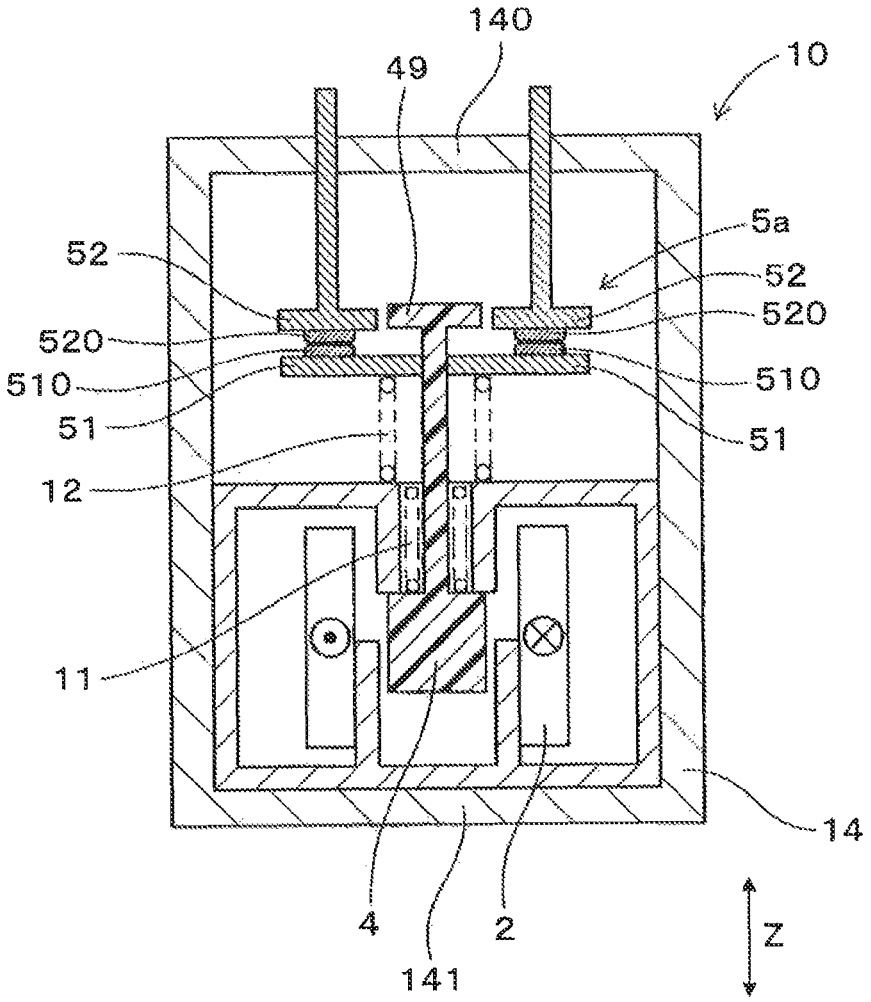
FIG. 24 is a cross section of an electromagnetic relay in a tenth embodiment.
Figure 25:
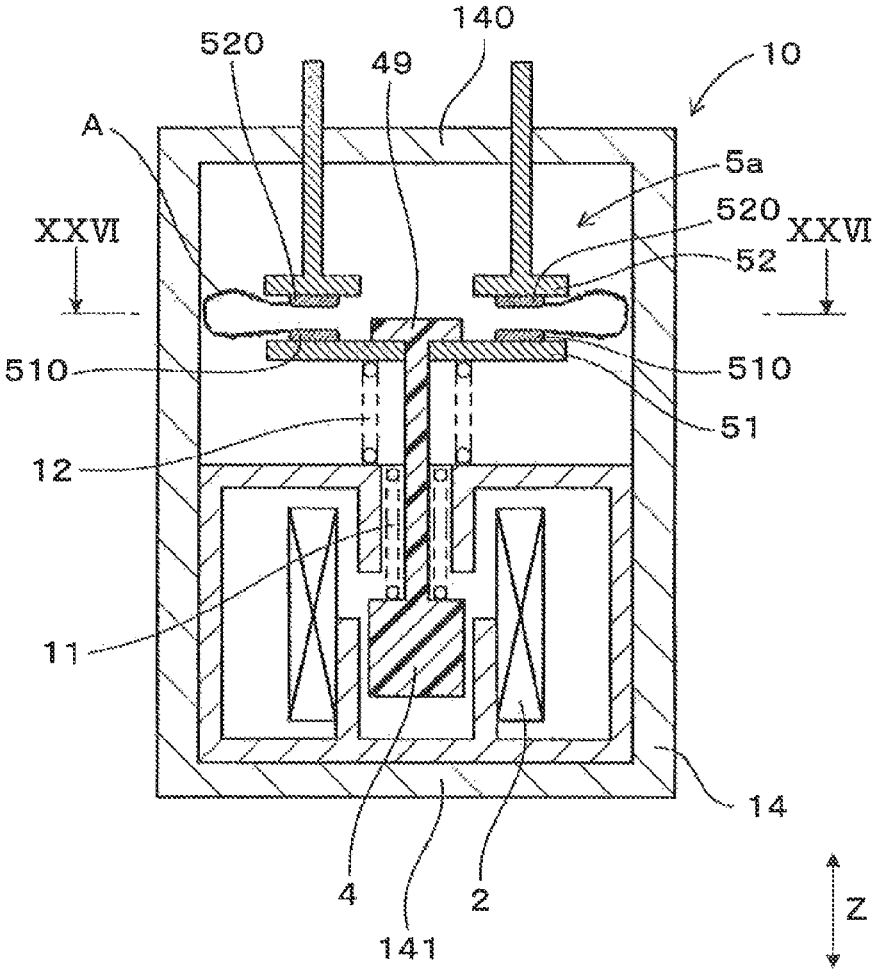
FIG. 25 is a cross section taken along line XXV-XXV of FIG. 26, illustrating an electromagnetic relay in which current to an electromagnetic coil is stopped in the tenth embodiment.
Figure 26:
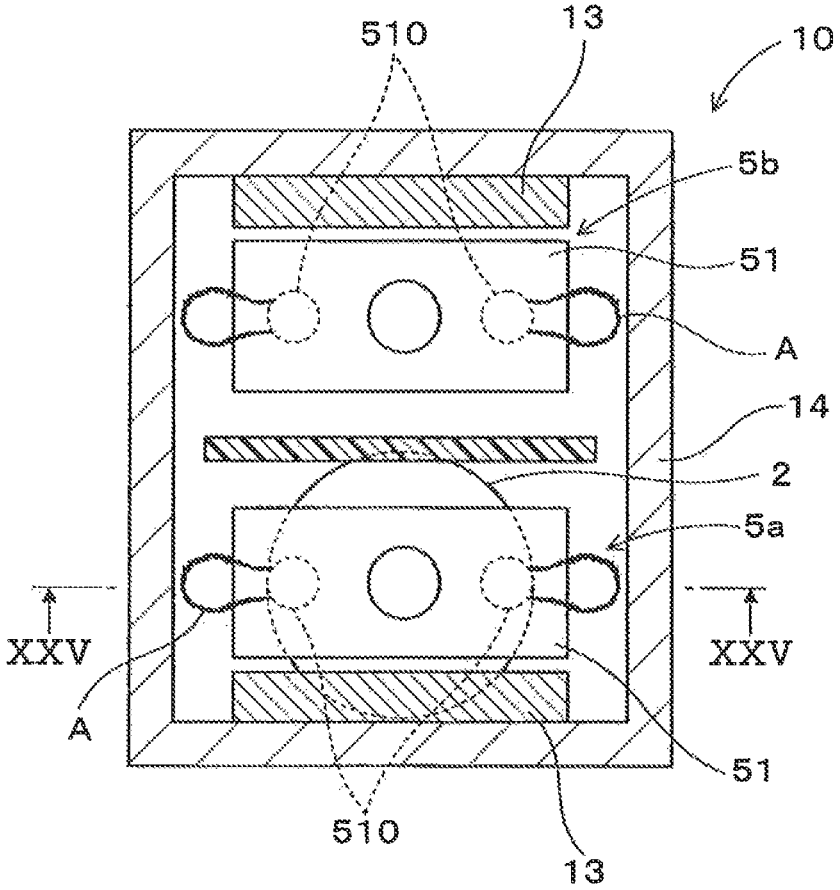
FIG. 26 is a cross section taken along line XXV-XXV of FIG. 25.

In a tenth embodiment, the structure of the contact part 5 is changed. As illustrated in FIGS. 24 to 26, in the embodiment, the moving-contact supporting part 51 is disposed on the side of the electromagnetic coil 2 in the Z direction, and the fixed-contact supporting part 52 is disposed on the side of the upper wall 140 in the Z direction. The plunger pressing member 11 presses the plunger 4 to the side of a bottom wall 141 of the casing 14. The contact pressing member 12 presses the moving-contact supporting part 51 to the side of the upper wall 140 of the casing 14.

As illustrated in FIG. 24, when current is passed to the electromagnetic coil 2, magnetic force is generated. By the magnetic force, the plunger 4 is moved to the side of the upper wall 140. A hook nail 49 of the plunger 4 is unhooked from the moving-contact supporting part 51 and, by the pressing force of the contact pressing member 12, the moving-contact supporting part 51 is pressed to the side of the upper wall 140. As a result, the moving contact 510 comes into contact with the fixed contact 520, and the contact part 5 enters an on state.

As illustrated in FIG. 25, when passage of current to the electromagnetic coil 2 is stopped, the magnetic force decreases and, by the pressing force of the plunger pressing member 11, the plunger 4 is moved to the side of the bottom wall 141. The hook nail 49 of the plunger 4 comes into engagement with the moving-contact supporting part 51 to attract the moving-contact supporting part 51 to the side of the bottom wall 141. As a result, the moving contact 510 is apart from the fixed contact 520, and the contact part 5 enters an off state.

In the embodiment, hydrogen gas is sealed in the casing 14. By sealing hydrogen gas, endothermic reaction occurs when the arc A is generated, and the arc A is extinguished more easily.

The other configuration and effects of the embodiment are similar to those of the first embodiment.

(Modifications)

Figure 27:
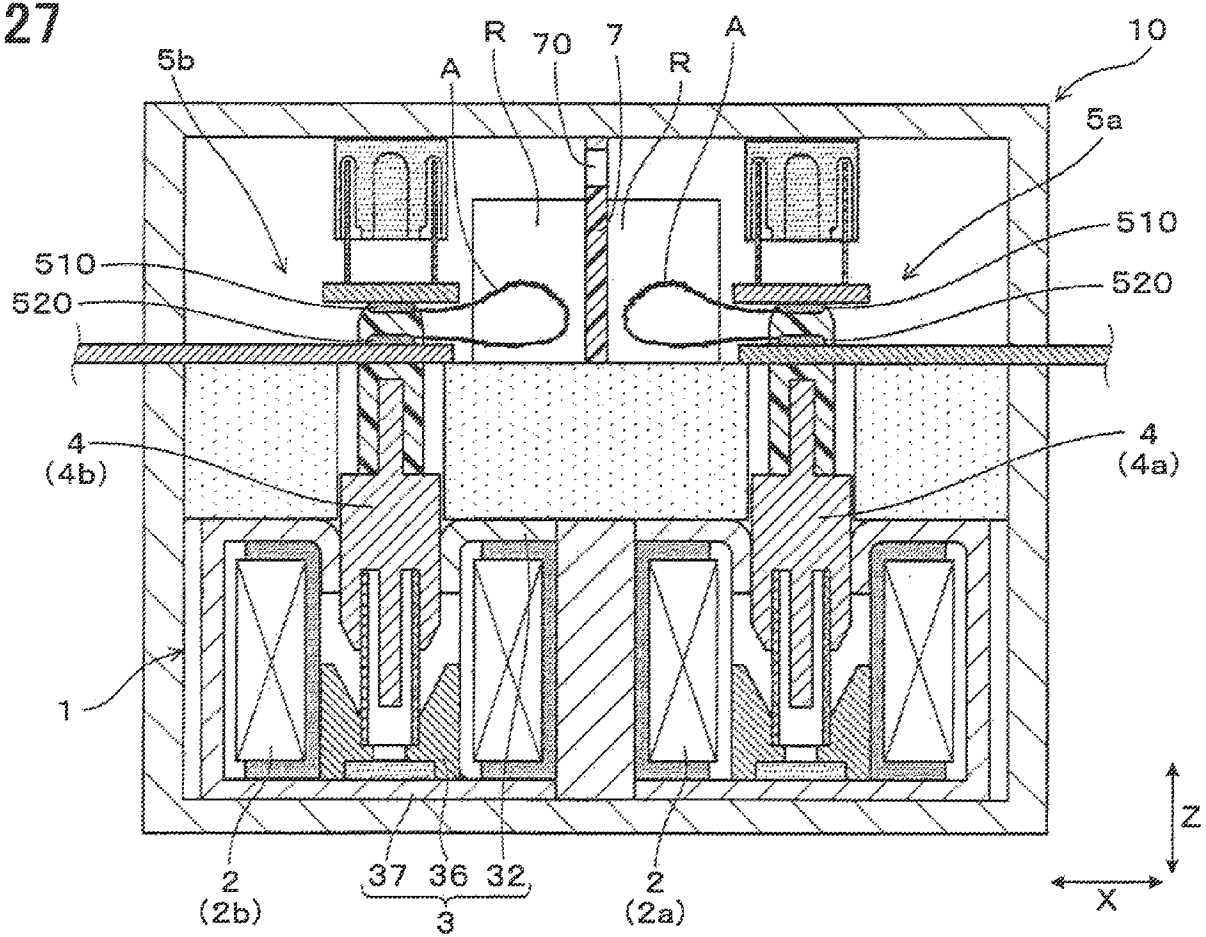
FIG. 27 is a cross section of an electromagnetic relay in a reference example.
Figure 28:
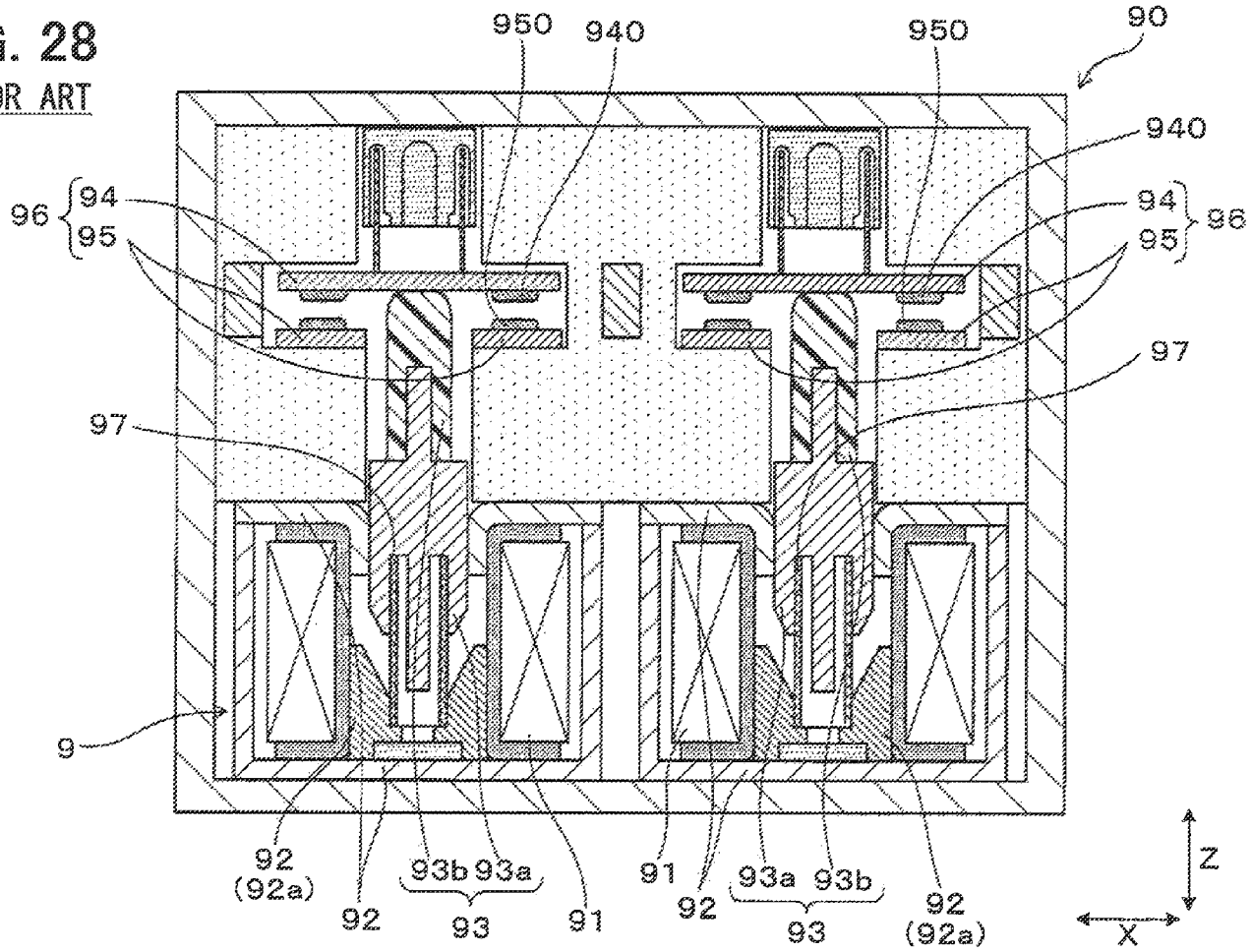
FIG. 28 PRIOR ART
FIG. 28 is a vertical cross section illustrating an off state of a conventional solenoid device.
Figure 29:
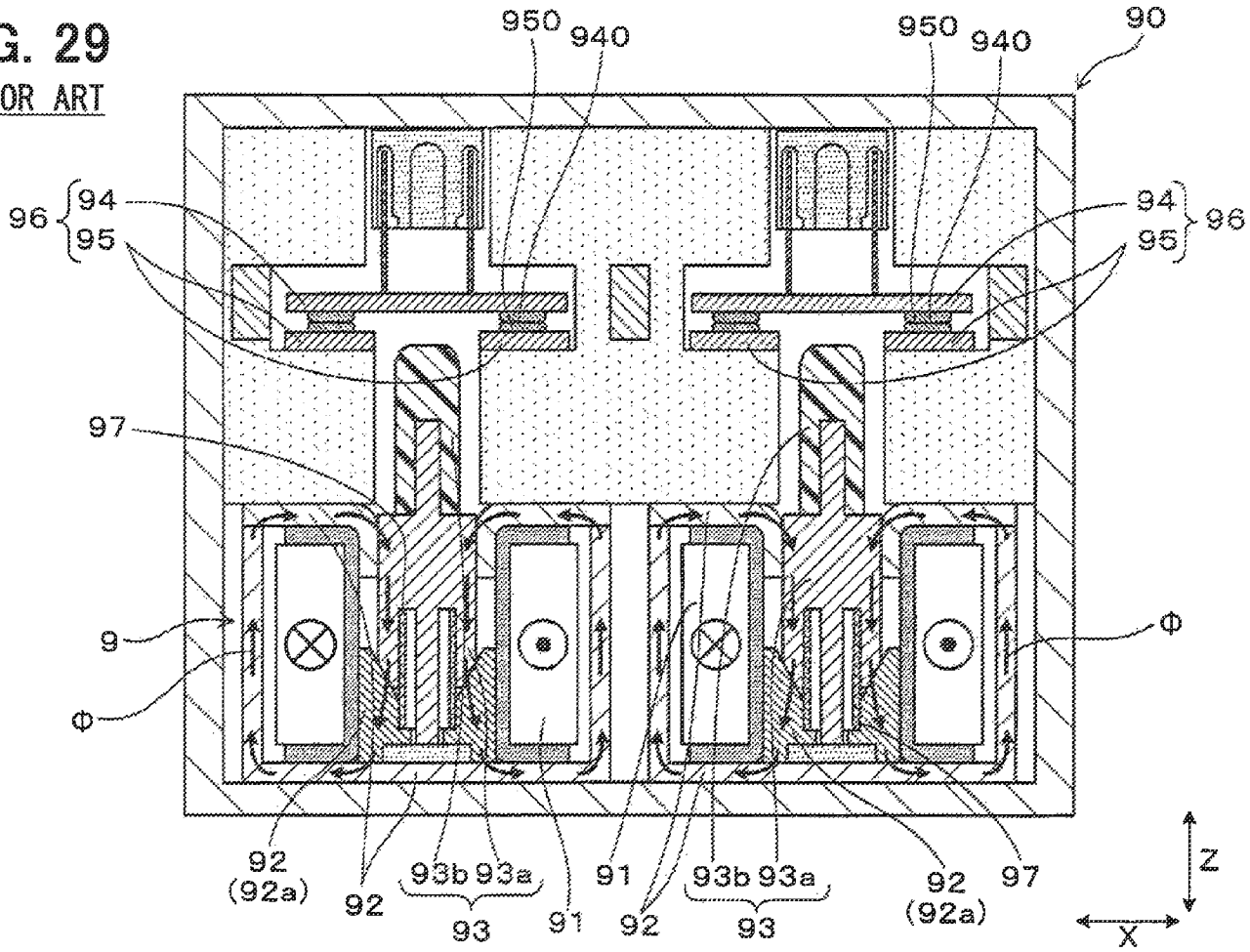
FIG. 29 PRIOR ART
FIG. 29 is a vertical cross section illustrating an on state of the solenoid device shown in FIG. 28.
Figure 30:
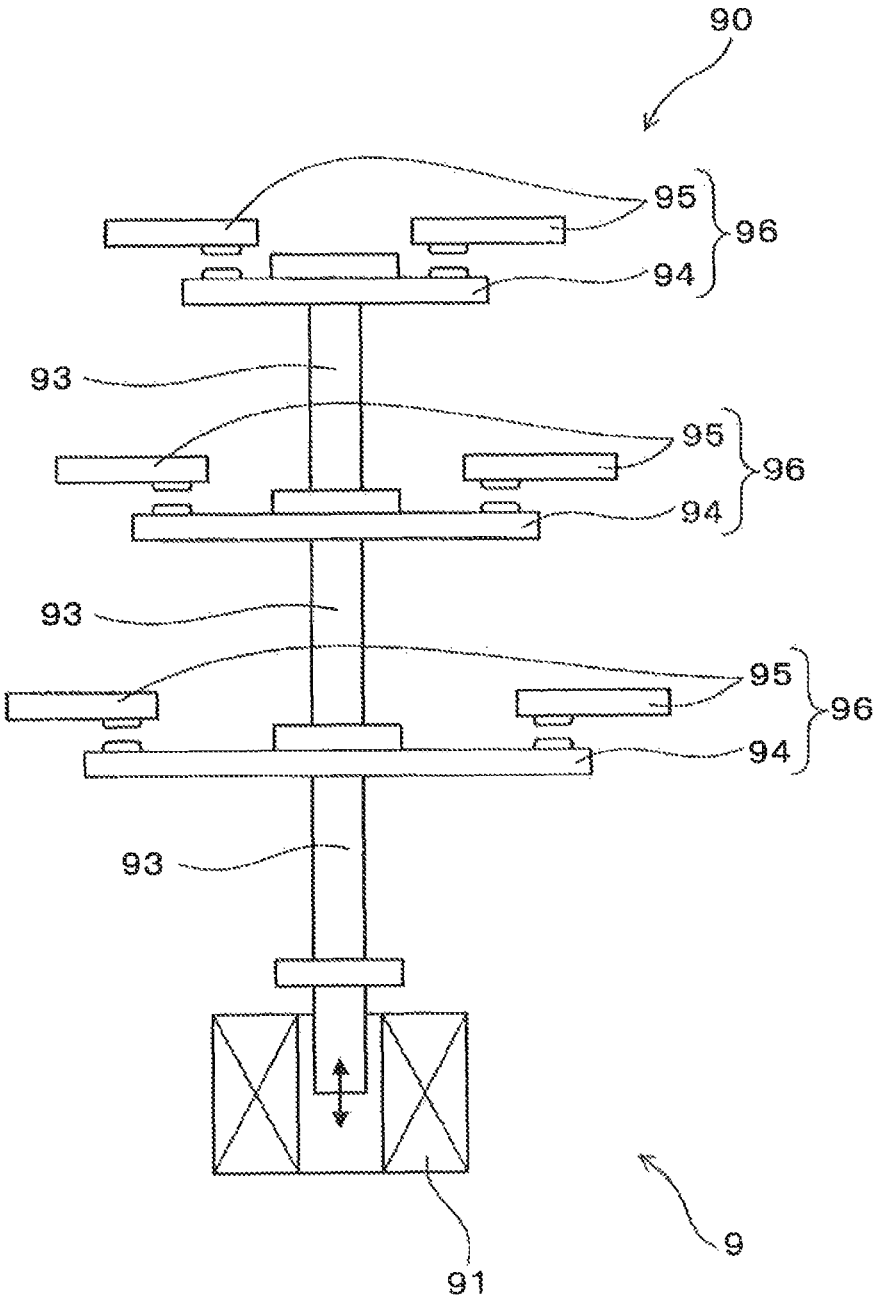
FIG. 30 RELATED ART
FIG. 30 is a conceptual diagram of a solenoid device different from that of FIGS. 28 and 29.

As a modification, the number of the electromagnetic coils 2 is changed. In the modification, as illustrated in FIG. 27, two plungers 4 (4*a* and 4*b*) and two electromagnetic coils 2 (2*a* and 2*b*) are provided. The plungers 4*a* and 4*b* are disposed on the inside of the electromagnetic coils 2*a* and 2*b*, respectively. By switching the current passage state and the current passage stop state of each of the electromagnetic coils 2*a* and 2*b*, the plungers 4*a* and 4*b* reciprocate. By the reciprocating operation of the plungers 4*a* and 4*b*, the contact parts 5*a* and 5*b* are turned on/off.

In a manner similar to the seventh embodiment, the arc contact preventing plate 7 is disposed between the two contact parts 5*a* and 5*b*. The through hole 70 is formed in the arc contact preventing plate 7. When the contact part 5 is switched from the on state to the off state, the arc A is generated. By the heat of the arc A, the contact parts 510 and 520 are heated and metallic vapor is generated. The concentration of the metallic vapor may vary depending on the arc-extinction room R. When the through hole 70 is formed in the arc contact preventing plate 7, the metallic vapor moves from an arc-extinction room R in which the concentration of the metallic vapor is low to an arc-extinction room R in which the concentration of the metallic vapor is high via the through hole 70. Consequently, the concentration of the metallic vapor can be prevented from becoming locally high, and the arc A is extinguished more easily.

The other configuration and effects of the modification are similar to those of the seventh embodiment.

The above disclosure has the following aspects.

According to a first aspect of the present disclosure, a solenoid device includes: at least one electromagnetic coil that generates a magnetic flux when the electromagnetic coil is energized; a yoke made of soft magnetic material, in which the magnetic flux flows; and a plurality of plungers, each of which includes at least a part made of soft magnetic material, and reciprocates when the electromagnetic coil is switched between energization and interruption of energization. The number of the plurality of plungers is larger than the number of the electromagnetic coil. The plurality of plungers reciprocate independently from each other.

In the above solenoid device, the number of the plungers is larger than the number of the electromagnetic coils. Consequently, the larger number of plungers can be made to reciprocate by the smaller number of electromagnetic coils, so that the manufacture cost of the solenoid device can be reduced. In addition, the solenoid device can be miniaturized.

The solenoid device can be constructed so that the plurality of plungers can reciprocate independent of one another. Therefore, even in the case where something abnormal occurs and one of the plurality of plungers does not reciprocate, the other plungers can be operated normally.

As described above, the small-sized low-manufacture-cost solenoid device, in which even in the case one of the plurality of plungers does not operate, the other plungers can reciprocate, is provided.

The above-described expression "a plurality of plungers can reciprocate independently of one another" means that, for example, a plurality of plungers are not integrated and, even one of the plungers cannot reciprocate, the other plungers can reciprocate.

The solenoid device can be used for, for example, an electromagnetic clutch, opening/closing of a flow valve, or the like.

The solenoid device can be also used for an electromagnetic relay. The electromagnetic relay has a plurality of contact parts having a fixed contact and a moving contact. Each of the contact parts can be connected/disconnected by the plunger.

The electromagnetic relay is used for a circuit which operates normally when only a part of the plurality of contact parts is connected/disconnected.

As described above, in the solenoid device, even in the case where a part of the plurality of plungers does not reciprocate, the other plungers can reciprocate. Consequently, for example, even in the case where a part of the plurality of connection parts is adhered, the other connection part can be connected/disconnected by the operating plunger. In such a manner, the circuit can be operated normally as a whole.

Alternatively, the plurality of plungers may be magnetically connected in parallel with each other via the yoke. In this case, the force of attracting each plunger can be increased. That is, in the case where the magnetic flux of the electromagnetic coil is not passed to the yoke, the plunger is apart from the yoke, and a gap is created between the plunger and the yoke. Consequently, at the time of passing the magnetic flux, the gap becomes magnetic resistance. Therefore, even if the plungers are magnetically connected in series, the magnetic resistance of the whole increases, the magnetic flux flowing in the plungers decreases, and the force of attracting the plungers becomes weaker. However, by magnetically connecting the plungers in parallel as described above, the magnetic resistance of the whole can be reduced, and the magnetic flux flowing in each of the plungers can be increased. As a result, the force of attracting the plunger by the yoke can be increased. The expression "a plurality of plungers are magnetically connected in parallel by a yoke" denotes that a magnetic flux generated by the electromagnetic coil is branched in a yoke and branched fluxes flow separately in a plurality of plungers.

Alternatively, the solenoid device may further include: at least one magnetic saturation part, which locally saturates the magnetic flux when the electromagnetic coil is energized. The at least one magnetic saturation part is disposed in the yoke or a corresponding plunger. An amount of the magnetic flux flowing in each plunger is regulated by the at least one magnetic saturation part. In this case, when the magnetic flux is passed, all of the plungers can be reliably attracted by the yoke. That is, in the configuration of magnetically connecting a plurality of plungers in parallel, there is a case that a part of the plungers is attracted by the yoke faster than the other plungers. In this case, if the magnetic saturation parts are not formed, a large amount of the magnetic flux flows in the plunger which is attracted first, so that the magnetic flux does not easily flow in the other plungers. Due to this, the other plungers are not easily attracted by the yoke. However, by forming the magnetic saturation parts, the amount of the magnetic flux flowing in each of the plungers can be regulated. Consequently, even if a part of the plungers is attracted faster by the yoke, the magnetic flux can be passed also to the other plungers. As a result, the magnetic flux can be sufficiently passed to all of the plungers, and all of the plungers can be attracted by the yoke. The expression "magnetic saturation" denotes being in a magnetic saturation region of a BH curve. The magnetic saturation region can be defined as a region in which the magnetic flux density is 50% or higher of saturation magnetic flux density. The saturation magnetic flux density denotes magnetic density in a state where the strength of magnetization does not increase even when the magnetic field is applied from the outside to a magnetic member. Without forming the magnetic saturation part, by increasing the magnetic flux of the electromagnetic coil, the yoke or the plunger can be partly magnetically saturated. However, the size of the electromagnetic coil becomes bigger and power consumption is also increased. Consequently, it is preferable to form the magnetic saturation part.

Alternatively, the yoke may include a pillar-shaped yoke penetrating a center of turns of the electromagnetic coil and a plate-shaped yoke having a plate shape and connected to one end of the pillar-shaped yoke. The plurality of plungers reciprocate in parallel to an axial direction of the electromagnetic coil. The plate-shaped yoke includes a connection part connected to the pillar-shaped yoke and a plurality of plunger insertion holes, through which the plungers pass, respectively. The yoke further includes a plurality of through holes penetrating the plate-shaped yoke in a thickness direction of the plate-shaped yoke. Each through hole is disposed between the connection part and a corresponding plunger insertion hole. A width direction is defined to be perpendicular to both of the axial direction and an arrangement direction from the connection part to the corresponding plunger insertion hole. A part of the plate-shaped yoke disposed on both sides of a corresponding through hole in the width direction provides the at least one magnetic saturation part. In this case, the amount of the magnetic flux flowing in each of the plungers can be regulated by the magnetic saturation part, and friction between the inner face of the plunger insertion hole and the plunger can be reduced. That is, with the above-described configuration, since the through hole is formed between the plunger and the connection part, the magnetic flux cannot flow in the through hole but is branched, and the branched magnetic fluxes pass through two magnetic saturation parts existing near the plunger insertion hole. Consequently, the plunger is not largely attracted by the connection part side but is attracted with small force by the two magnetic saturation parts. Each of the force of attracting the plunger by one of the two magnetic saturation parts and the force of attracting the plunger by the other magnetic saturation part is small, and the directions of the forces are different from each other. Therefore, the attraction forces are cancelled off. Therefore, the plunger can be prevented from being attracted by a large force in a specific direction. As a result, the plunger does not slide along the inner face of the plunger insertion hole with strong force, and friction generated between them can be reduced.

Alternatively, at least one of the plurality of plungers may be disposed on an outside of the electromagnetic coil. In this case, the number of plungers disposed on the inside of the electromagnetic coil can be decreased, so that the diameter of the electromagnetic coil can be reduced, and the electromagnetic coil can be miniaturized. The length of the conduction wire constructing the electromagnetic coil can be shortened, and the manufacture cost of the electromagnetic coil can be reduced.

Alternatively, at least one of the plurality of plungers may be disposed on an outside of the electromagnetic coil, and other plungers are disposed on an inside of the electromagnetic coil. In this case, the number of plungers disposed on the inside of the electromagnetic coil can be decreased, so that the diameter of the electromagnetic coil can be reduced, and the electromagnetic coil can be miniaturized. In addition, the length of the conduction wire constructing the electromagnetic coil can be shortened, and the manufacture cost of the electromagnetic coil can be reduced. By disposing the other plunger on the inside of the electromagnetic coil, when current is passed to the electromagnetic coil, a larger amount of the magnetic flux can be passed to the other plunger. Thus, when current is passed to the electromagnetic coil, the other plunger can be attracted faster than the plunger disposed on the outside of the electromagnetic coil.

Alternatively, the electromagnetic coil may include a plurality of coil parts, which are adjacent to each other along a direction in parallel to a reciprocating direction of each plunger. In this case, a magnetic force is generated by passing current to all of the plurality of parts at the time of attracting the plunger, and the plunger can be attracted by the strong magnetic force. After the plunger is attracted, by stopping the current passage to a part of the plurality of parts, while saving power, the plunger can be continuously attracted.

Alternatively, the yoke may include a plurality of attraction yokes, each of which faces a corresponding plunger in a reciprocating direction of the corresponding plunger. The plurality of plungers include a first attraction plunger and a second attraction plunger. The first attraction plunger is attracted by a corresponding attraction yoke prior to the second attraction plunger when the electromagnetic coil is switched from the interruption of energization to the energization. The yoke further includes a magnetic saturation part for saturating the magnetic flux locally. The magnetic saturation part is disposed on a path of the magnetic flux flowing into the first attraction plunger. An amount of the magnetic flux flowing into the first attraction plunger is regulated by the magnetic saturation part. In this case, since the magnetic flux flowing in the first attraction plunger is regulated by the magnetic saturation part, after the first attraction plunger is attracted, the magnetic flux can be sufficiently passed also to the afterward attraction plunger. Consequently, the afterword attraction plunger can be reliably attracted.

Alternatively, the yoke may include a plurality of attraction yokes, each of which faces a corresponding plunger in a reciprocating direction of the corresponding plunger. The plurality of plungers are attracted by the plurality of attraction yokes, respectively, when the electromagnetic coil is energized. Amounts of the magnetic flux flowing into the plurality of plungers are different from each other when the plurality of plungers are attracted. When the energization of the electromagnetic coil is interrupted, attraction of the plurality of plungers is terminated in increasing order of the amounts of the magnetic flux under a condition that the plurality of plungers are attracted. In this case, attraction of the plurality of plungers can be cancelled in predetermined order. Consequently, for example, in the case of using the solenoid device for an electromagnetic relay, the on/off state of the plurality of contact parts can be switched in predetermined order by the plunger attraction cancelling operation. In the case of using the solenoid device for a solenoid valve, a plurality of valves can be opened/closed in predetermined order.

Alternatively, when the energization of the electromagnetic coil is interrupted, a voltage applied to the electromagnetic coil may be decreased in a step-by-step manner. When the voltage of the electromagnetic coil is decreased step by step, the magnetic force generated in each of the plungers decreases step by step. Therefore, attraction of the plurality of plungers can be cancelled more reliably in order from the plunger with the smallest amount of the magnetic flux at the time of attraction (the plunger with the weakest magnetic force to be attracted).

Alternatively, under a condition that the energization of the electromagnetic coil is interrupted, each plunger may be movable in a reciprocating direction of the plunger. Frequencies of movement of the plurality of plungers in the reciprocating directions are different from each other under the condition that the energization of the electromagnetic coil is interrupted. When the frequencies of vibrations in the plurality of plungers are equal to one another, there is a case such that the plurality of plungers simultaneously operate in the same direction by the vibration. Due to this, for example, when the solenoid device is used for an electromagnetic relay, a plurality of contact parts may be simultaneously turned on. It causes an inconvenience such that an electronic device connected to the electromagnetic relay operates at unexpected time. Therefore, by making the frequencies of vibrations of the plungers different from one another, the plurality of contact parts are prevented from being turned on at the same time, and the inconvenience can be prevented. To make the frequencies of vibrations of the plurality of plungers different from one another, for example, a method of varying the mass of the plungers different from one another or the spring constant of spring members pressing the plungers different from one another can be employed.

According to a second aspect of the present disclosure, an electromagnetic relay includes: the solenoid device according to the first aspect; a plurality of contact parts, each of which is switchable between an on state for flowing current and an off state for interrupting the current; and an arc contact preventing plate made of an insulating material and disposed between the plurality of contact parts. The arc contact preventing plate prevents from contacting arcs, which are generated in the contact parts, respectively, when the contact parts are switched from the on state to the off state. The arc contact preventing plate includes a through hole.

In the above case, by the through hole formed in the arc contact preventing plate, the arc can be extinguished quickly. That is, when an arc is generated, a part of the metal of the contact part is heated by the heat of the arc, and metallic vapor is generated. When the concentration of the metallic vapor in the space where the arc is generated becomes high, it becomes difficult to extinguish the arc. The generation amount of the metallic vapor varies depending on the contact part. When the through hole is formed in the arc contact preventing plate, the metallic vapor can be moved via the through hole from the space in which the concentration of the metallic vapor is high to the space in which the concentration is low. Consequently, local increase in the concentration of the metallic vapor can be suppressed, and the arcs can be extinguished quickly.

Alternatively, the plurality of contact parts may be switched from the on state to the off state in a predetermined order. For example, current may be interrupted by using only a part of the plurality of contact parts, and the other contact parts can be used as a fail-safe. The contact part for current cutoff is switched first from the on state to the off state and, after that, the contact part for a fail-safe is switched from the on state to the off state. In this case, although the arc and metallic vapor are generated when the connection part for current cutoff is switched from the on state to the off state, the arc and metallic vapor are not generated from the contact part for a fail-safe. Consequently, by providing the through hole in the arc contact preventing plate as described above, the metallic vapor generated from the contact part for current cutoff can be moved to the contact part for a fail-safe (the contact part from which no metallic vapor is generated) via the through hole. As a result, the concentration of the metallic vapor in the periphery of the contact part for current cutoff can be effectively decreased. Accordingly, the arc can be extinguished quickly.

Alternatively, the plurality of contact parts may be switched between the on state and the off state independently from each other. In this case, even when a part of the plurality of contact parts is adhered, the other contact parts can be turned off. Consequently, for example, by setting a part of the contact parts as a contact part for current cutoff and setting the other contact part as a contact part for a fail-safe, even in the case where a part of the contact part is adhered, the other contact part can be turned off and current can be interrupted.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. A solenoid device comprising:

at least one electromagnetic coil that generates a magnetic flux when the electromagnetic coil is energized;

a yoke made of soft magnetic material, in which the magnetic flux flows; and a plurality of plungers, each of which includes at least a part made of soft magnetic material, and reciprocates when the electromagnetic coil is switched between energization and interruption of energization, wherein the number of the plurality of plungers is larger than the number of the electromagnetic coil, wherein the plurality of plungers are magnetically connected in parallel with each other via the yoke, wherein each plunger of the plurality of plungers reciprocates independently from each other, and wherein a whole of each one of the plurality of plungers is disposed on an outside of the electromagnetic coil.

2. The solenoid device according to claim 1, further comprising:

at least one magnetic saturation part, which locally saturates the magnetic flux when the electromagnetic coil is energized, wherein the at least one magnetic saturation part is disposed in the yoke or a corresponding plunger, and wherein an amount of the magnetic flux flowing in each plunger is regulated by the at least one magnetic saturation part.

3. The solenoid device according to claim 1, wherein the electromagnetic coil includes a plurality of coil parts, which are adjacent to each other along a direction in parallel to a reciprocating direction of each plunger.

4. The solenoid device according to claim 1, wherein the yoke includes a plurality of attraction yokes, each of which faces a corresponding plunger in a reciprocating direction of the corresponding plunger, wherein the plurality of plungers are attracted by the plurality of attraction yokes, respectively, when the electromagnetic coil is energized, wherein amounts of the magnetic flux flowing into the plurality of plungers are different from each other when the plurality of plungers are attracted, and wherein, when the energization of the electromagnetic coil is interrupted, attraction of the plurality of plungers is terminated in increasing order of the amounts of the magnetic flux under a condition that the plurality of plungers are attracted.

5. The solenoid device according to claim 4, wherein, when the energization of the electromagnetic coil is interrupted, a voltage applied to the electromagnetic coil is decreased in a step-by-step manner.

6. The solenoid device according to claim 1, wherein, under a condition that the energization of the electromagnetic coil is interrupted, each plunger is movable in a reciprocating direction of the plunger, wherein frequencies of movement of the plurality of plungers in the reciprocating directions are different from each other under the condition that the energization of the electromagnetic coil is interrupted.

7. A solenoid device comprising:

at least one electromagnetic coil that generates a magnetic flux when the electromagnetic coil is energized;

a yoke made of soft magnetic material, in which the magnetic flux flows; and a plurality of plungers, each of which includes at least a part made of soft magnetic material, and reciprocates when the electromagnetic coil is switched between energization and interruption of energization, wherein the number of the plurality of plungers is larger than the number of the electromagnetic coil, wherein the plurality of plungers reciprocate independently from each other, wherein the plurality of plungers are magnetically connected in parallel with each other via the yoke, further comprising at least one magnetic saturation part, which locally saturates the magnetic flux when the electromagnetic coil is energized, wherein the at least one magnetic saturation part is disposed in the yoke or a corresponding plunger, wherein an amount of the magnetic flux flowing in each plunger is regulated by the at least one magnetic saturation part wherein the yoke includes a pillar-shaped yoke penetrating a center of turns of the electromagnetic coil and a plate-shaped yoke having a plate shape and connected to one end of the pillar-shaped yoke, wherein the plurality of plungers reciprocate in parallel to an axial direction of the electromagnetic coil, wherein the plate-shaped yoke includes a connection part connected to the pillar-shaped yoke and a plurality of plunger insertion holes, through which the plungers pass, respectively, wherein the yoke further includes a plurality of through holes penetrating the plate-shaped yoke in a thickness direction of the plate-shaped yoke, wherein each through hole is disposed between the connection part and a corresponding plunger insertion hole, and wherein a width direction is defined to be perpendicular to both of the axial direction and an arrangement direction from the connection part to the corresponding plunger insertion hole, and wherein a part of the plate-shaped yoke disposed on both sides of a corresponding through hole in the width direction provides the at least one magnetic saturation part.

8. A solenoid device comprising:

at east one electromagnetic coil that generates a magnetic flux when the electromagnetic coil is energized;

a yoke made of soft magnetic material, in which the magnetic flux flows; and a plurality of plungers, each of which includes at least a part made of soft magnetic material, and reciprocates when the electromagnetic coil is switched between energization and interruption of energization, wherein the number of the plurality of plungers is larger than the number of the electromagnetic coil, wherein the plurality of plungers reciprocate independently from each other, and wherein a whole of at least one of the plurality of plungers is disposed on an outside of the electromagnetic coil, wherein the yoke includes a plurality of attraction yokes, each of which faces a corresponding plunger in a reciprocating direction of the corresponding plunger, wherein the plurality of plungers include a first attraction plunger and a second attraction plunger, wherein the first attraction plunger is attracted by a corresponding attraction yoke prior to the second attraction plunger when the electromagnetic coil is switched from the interruption of energization to the energization, wherein the yoke further includes a magnetic saturation part for saturating the magnetic flux locally, wherein the magnetic saturation part is disposed on a path of the magnetic flux flowing into the first attraction plunger, and wherein an amount of the magnetic flux flowing into the first attraction plunger is regulated by the magnetic saturation part.

* * * * *